US010336501B2

(12) United States Patent
Smith

(10) Patent No.: US 10,336,501 B2
(45) Date of Patent: Jul. 2, 2019

(54) POLYGONAL CONTAINERS HAVING A LOCKING BOTTOM AND BLANKS AND METHODS FOR FORMING THE SAME

(71) Applicant: WestRock Shared Services, LLC, Norcross, GA (US)

(72) Inventor: Kenneth C. Smith, Hiram, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 311 days.

(21) Appl. No.: 15/358,298

(22) Filed: Nov. 22, 2016

(65) Prior Publication Data

US 2017/0166348 A1 Jun. 15, 2017

Related U.S. Application Data

(60) Provisional application No. 62/338,141, filed on May 18, 2016, provisional application No. 62/265,863, filed on Dec. 10, 2015.

(51) Int. Cl.

| | |
|---|---|
| ***B65D 5/10*** | (2006.01) |
| ***B65D 5/02*** | (2006.01) |
| ***B65D 5/00*** | (2006.01) |
| ***B65D 5/42*** | (2006.01) |
| ***B31B 50/60*** | (2017.01) |
| *B31B 100/00* | (2017.01) |
| *B31B 120/30* | (2017.01) |
| *B31B 50/73* | (2017.01) |

(52) U.S. Cl.

CPC ..... *B65D 5/029* (2013.01); *B31B 50/60* (2017.08); *B65D 5/001* (2013.01); *B65D 5/10* (2013.01); *B65D 5/103* (2013.01); *B65D 5/106* (2013.01); *B65D 5/4212* (2013.01); *B65D 5/4266* (2013.01); *B31B 50/734* (2017.08); *B31B 2100/00* (2017.08); *B31B 2120/30* (2017.08)

(58) Field of Classification Search

CPC ..... B65D 5/026; B65D 5/001; B65D 5/10; B65D 5/103; B65D 5/106; B65D 5/4212; B65D 5/4266; B31B 50/60; B31B 2120/30; B31B 50/734; B31B 2100/00

See application file for complete search history.

(56) References Cited

U.S. PATENT DOCUMENTS 1,653,116 A 12/1927 Parks
2,295,141 A 9/1942 VanWingen
(Continued)

OTHER PUBLICATIONS http://sierrapack.com/fci.html; "1-2-3 Houghland Snap Lock Bottom"; Paperboard Packaging Council Handbook of Folding Carton Style Nomenclature; 1 page.

(Continued)

*Primary Examiner* — Corey N Skurdal
(74) *Attorney, Agent, or Firm* — WestRock Intellectual Property Group

(57) ABSTRACT

A blank for forming a polygonal container and the container formed therefrom are described herein. The blank includes a plurality of side panels, including a first side panel and a second side panel, a corner panel connected to the first side panel and the second side panel by fold lines, a bottom panel extending from the first side panel, and an engagement member defined on bottom panel. The engagement member is configured to engage an interior surface of the corner panel to prevent movement of the corner panel relative to the first and second side panels when the container is formed from the blank.

14 Claims, 20 Drawing Sheets

(56) References Cited

U.S. PATENT DOCUMENTS

| | | | |
|---|---|---|---|
| 2,348,378 | A | 5/1944 | Goodyear |
| 2,826,350 | A | 3/1958 | Marx |
| 3,501,081 | A | 3/1970 | Paige |
| 3,517,875 | A | 6/1970 | Wakefield |
| 3,770,187 | A | 11/1973 | Faires |
| 3,809,310 | A | 5/1974 | Vanderlugt |
| 4,007,869 | A | 2/1977 | Stolkin et al. |
| 4,013,213 | A | 3/1977 | Giebel |
| 4,063,679 | A | 12/1977 | Henry |
| 4,068,796 | A | 1/1978 | Kullman |
| 4,094,459 | A | 6/1978 | Coons |
| 4,187,976 | A | 2/1980 | Mather |
| 4,218,009 | A | 8/1980 | DonCarlos |
| 4,260,100 | A | 4/1981 | Hoffman |
| 4,264,031 | A | 4/1981 | Goebel |
| 4,289,268 | A | 9/1981 | Paige |
| 4,291,828 | A | 9/1981 | Nigro |
| 4,361,267 | A | 11/1982 | Wozniacki |
| 4,386,729 | A | 6/1983 | Schmidt |
| 4,502,624 | A | 3/1985 | Burrell |
| 4,530,460 | A | 7/1985 | Hinton |
| 4,572,424 | A | 2/1986 | Muise et al. |
| 4,583,678 | A | 4/1986 | Weimer |
| 4,702,408 | A | 10/1987 | Powlenko |
| 5,042,714 | A | 8/1991 | Hall |
| 5,066,269 | A | 11/1991 | Center et al. |
| 5,294,044 | A | 3/1994 | Clark |
| 5,522,628 | A | 6/1996 | Fillis |
| 5,664,726 | A | 9/1997 | Copper |
| 5,755,377 | A | 5/1998 | Durand |
| 5,775,575 | A | 7/1998 | Dorman et al. |
| 5,927,593 | A | 7/1999 | Berkowitz et al. |
| 6,109,513 | A | 8/2000 | Dugan |
| 6,290,123 | B1 | 9/2001 | Pei |
| 6,296,178 | B1 | 10/2001 | McKenna |
| 6,349,876 | B1 | 2/2002 | Dowd |
| 6,386,437 | B1 | 5/2002 | Larson |
| 6,460,758 | B1 | 10/2002 | Fenton et al. |
| 6,508,395 | B2 | 1/2003 | McLeod |
| 6,530,516 | B1 | 3/2003 | Ritter |
| 6,557,749 | B1 | 5/2003 | Gill |
| 6,637,645 | B2 | 10/2003 | Ferguson |
| 6,641,032 | B1 | 11/2003 | Schilling |
| 6,676,012 | B1 | 1/2004 | Southwell et al. |
| 6,705,515 | B2 | 3/2004 | Dowd |
| 6,761,307 | B2 | 7/2004 | Matsuoka |
| 6,899,266 | B2 | 5/2005 | Conway |
| 6,926,192 | B1 | 8/2005 | Dowd |
| 7,000,771 | B2 | 2/2006 | Kwong |
| 7,055,734 | B2 | 6/2006 | Provus et al. |
| 7,278,565 | B2 | 10/2007 | West |
| 7,290,696 | B2 | 11/2007 | McClure |
| 7,484,655 | B2 | 2/2009 | McLeod |
| 7,607,567 | B2 | 10/2009 | Fry et al. |
| 7,886,958 | B2 | 2/2011 | Smith |
| 8,931,686 | B2 | 1/2015 | Brundage et al. |
| 9,242,758 | B2 | 1/2016 | Brundage et al. |
| 2002/0121542 | A1 | 9/2002 | Holladay |
| 2002/0158114 | A1 | 10/2002 | Evans et al. |
| 2003/0024971 | A1 | 2/2003 | Jones et al. |
| 2004/0211825 | A1 | 10/2004 | Champion et al. |
| 2004/0256448 | A1 | 12/2004 | Blomfield et al. |
| 2005/0011938 | A1 | 1/2005 | West |
| 2005/0284922 | A1 | 12/2005 | Feltz |
| 2007/0131746 | A1 | 6/2007 | Quaintance et al. |
| 2007/0152027 | A1 | 7/2007 | Hyatt et al. |
| 2008/0078819 | A1 | 4/2008 | Strong et al. |
| 2008/0110964 | A1 | 5/2008 | Churvis |
| 2008/0116249 | A1 | 5/2008 | West |
| 2009/0098991 | A1 | 4/2009 | Graham et al. |
| 2013/0277419 | A1 | 10/2013 | Wisecarver |

OTHER PUBLICATIONS http://sierrapack.com/fci.html; Sierra Packaging—Manufacturer of Custom Folding Cartons; Folding Carton Information; 6 pages.

POLYGONAL CONTAINERS HAVING A LOCKING BOTTOM AND BLANKS AND METHODS FOR FORMING THE SAME

REFERENCE TO RELATED APPLICATIONS

This application claims the benefit of priority under 35 U.S.C. § 119(e) of U.S. provisional application Ser. No. 62/265,863 filed on Dec. 10, 2015, and U.S. provisional application Ser. No. 62/338,141 filed on May 18, 2016, both of which are hereby incorporated by reference in their respective entireties.

BACKGROUND

The field of the invention relates generally to a polygonal container and, more particularly, to a non-rectangular container having a bottom wall formed from a plurality of interlocked bottom panels, wherein the bottom wall is configured to engage at least some side walls of the container to prevent movement of those side walls relative to each other.

At least some known containers are four-sided and include a bottom wall formed from a plurality of interlocked bottom panels. The interlocking bottom panels enable the rectangular container to be finally formed without using adhesives and/or tapes. When formed, these known containers include side walls that rest on top of or are positioned above the interlocking bottom panels. These containers are sometimes referred to as knocked-down-flat (KDF) containers. In other words, the side walls of the container are coupled together, but then the partially formed container is knocked down flat until it is needed, at which time the container is erected (oftentimes by hand), in part by interlocking the bottom panels to form the container. In addition, these KDF containers having side walls that rest on or above the bottom wall may be unable to hold their shape during formation, shipping, and/or storage thereof. In other words, the side walls can move, flex, or skew relative to each other. This movement of the side walls can cause the container to lose stacking strength.

Moreover, rectangular-shaped containers are oftentimes not suitable for a packaging application. Specifically, the item to be packed and shipped may not be rectangular and, therefore, a rectangular-shaped package may lack the desired space efficiency. Furthermore, a rectangular-shaped package may lack sufficient strength for stacking or bulge resistance. In these types of packaging applications, a shipping container having a non-rectangular configuration is better suited.

Accordingly, it is desirable to provide a non-rectangular container having a bottom wall formed from interlocking bottom panels that is able to prevent movement of the side walls relative to each other.

BRIEF DESCRIPTION

In one aspect, a blank for forming a polygonal container is provided. The blank includes a plurality of side panels, including a first side panel and a second side panel, a corner panel connected to the first side panel and the second side panel by fold lines, a bottom panel extending from the first side panel, and an engagement member defined on the bottom panel. The engagement member is configured to engage an interior surface of the corner panel to prevent movement of the corner panel relative to the first and second side panels when the container is formed from the blank.

In another aspect, a polygonal container is provided. The container includes a plurality of side walls, including a first side wall and a second side wall, a corner wall extending between the first side wall and the second side wall, a bottom wall including a bottom panel extending from a bottom edge of the first side wall, and an engagement member defined on the bottom panel. The engagement member engages an interior surface of the corner wall to prevent movement of the corner wall relative to the first and second side walls.

In yet another aspect, a method of forming a polygonal container from a blank is provided. The blank includes a plurality of side panels, including a first side panel and a second side panel, a corner panel connected to the first side panel and the second side panel by fold lines, a bottom panel extending from the first side panel, and an engagement member defined on the bottom panel. The method includes rotating the corner panel inwardly toward an interior surface of the first side panel, rotating the second side panel inwardly toward the interior surface of the corner panel, and rotating the bottom panel inwardly toward the interior surface of the first side panel. This rotating engages the engagement member with the interior surface of the corner panel to prevent movement of the corner panel relative to the first and second side panels.

In a further aspect, a blank for forming a polygonal container is provided. The blank includes a plurality of side panels, including a first side panel and a second side panel, a corner panel connected to the first side panel and the second side panel by fold lines, a bottom panel extending from the first side panel, and an engagement member defined on bottom panel. The engagement member extends from a first side edge of the bottom panel to an offset edge extending from a bottom edge of the first side panel. The engagement member is configured to engage an interior surface of the corner panel to prevent movement of the corner panel relative to the first and second side panels when the container is formed from the blank.

In another aspect, a polygonal container is provided. The container includes a plurality of side walls, including a first side wall and a second side wall, a corner wall extending between the first side wall and the second side wall, a bottom wall including a bottom panel extending from a bottom edge of the first side wall, and an engagement member defined on the bottom panel. The engagement member extends from a first side edge of the bottom panel to an offset edge extending from a bottom edge of the first side panel and engages an interior surface of the corner wall to prevent movement of the corner wall relative to the first and second side walls.

In a still further aspect, a method of forming a polygonal container from a blank is provided. The blank includes a plurality of side panels, including a first side panel and a second side panel, a corner panel connected to the first side panel and the second side panel by fold lines, a bottom panel extending from the first side panel, and an engagement member extending from a first side edge of the bottom panel to an offset edge extending from a bottom edge of the first side panel. The method includes rotating the corner panel inwardly toward an interior surface of the first side panel, rotating the second side panel inwardly toward the interior surface of the corner panel, and rotating the bottom panel inwardly toward the interior surface of the first side panel. This rotating engages the engagement member with the interior surface of the corner panel to prevent movement of the corner panel relative to the first and second side panels.

BRIEF DESCRIPTION OF THE DRAWINGS

FIG. 1 is a top plan view of an exemplary blank of sheet material according to a first embodiment of the invention.

FIG. 2 is a top perspective view of a container formed from the blank shown in FIG. 1 in a knocked-down-flat configuration.

FIG. 3 is a first bottom perspective view of the container shown in FIG. 2 illustrating formation of a bottom wall of the container to transition the container into an open configuration.

FIG. 4 is a second bottom perspective view of the container shown in FIG. 2 further illustrating formation of the bottom wall.

FIG. 5 is a third bottom perspective view of the container shown in FIG. 2 illustrating a formed bottom wall.

FIG. 6 is an enlarged view of the bottom wall shown in FIG. 5.

FIG. 7 is a perspective view of the container shown in FIG. 2 in an open configuration.

FIG. 8 is a top perspective view of an interior of the bottom wall of the container shown in FIG. 7 in the open configuration.

FIG. 9 is a top perspective view of a top wall of the container shown in FIG. 7.

FIG. 10 is a top plan view of an exemplary blank of sheet material according to a second embodiment of the invention.

FIG. 11 is a top perspective view of a container formed from the blank shown in FIG. 10 in a knocked-down-flat configuration.

FIG. 12 is a first bottom perspective view of the container shown in FIG. 11 illustrating formation of a bottom wall of the container to transition the container into an open configuration.

FIG. 13 is a second bottom perspective view of the container shown in FIG. 11 further illustrating formation of the bottom wall.

FIG. 14 is a third bottom perspective view of the container shown in FIG. 11 illustrating a formed bottom wall.

FIG. 15 is a perspective view of the container shown in FIG. 11 in an open configuration.

FIG. 16 is a top perspective view of an interior of the bottom wall of the container shown in FIG. 15 in the open configuration.

FIG. 17 is a first top perspective view of the container shown in FIG. 15 illustrating formation of a top wall of the container to transition the container into a closed configuration.

FIG. 18 is a second top perspective view of the container shown in FIG. 15 further illustrating formation of the top wall.

FIG. 19 is a third top perspective view of the container shown in FIG. 15 further illustrating formation of the top wall.

FIG. 20 is a top perspective view of a top wall of the container shown in FIG. 15.

DETAILED DESCRIPTION

Figure 1:
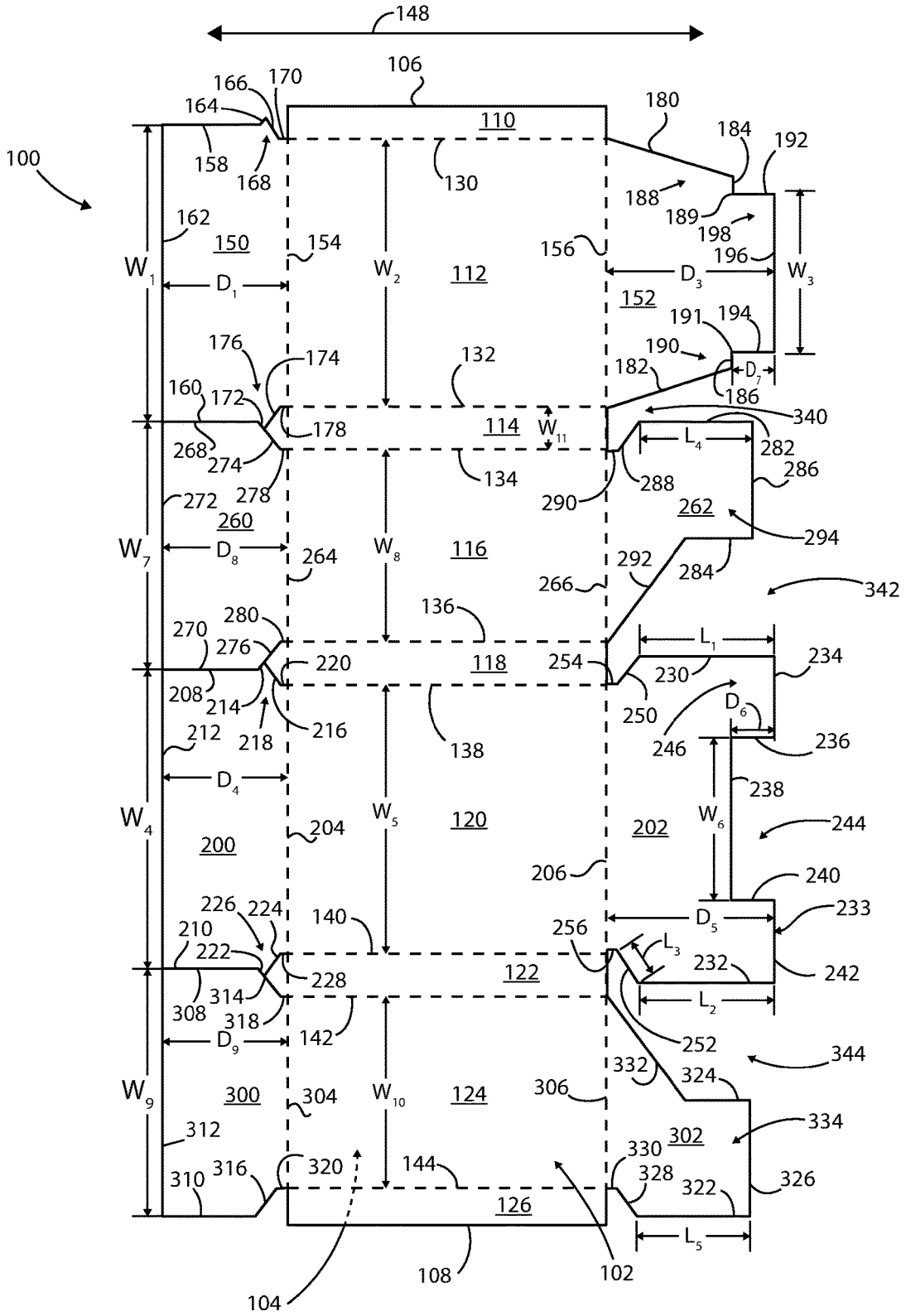
FIGS. 1-20 show exemplary embodiments of the apparatus and methods described herein.

The following detailed description illustrates the disclosure by way of example and not by way of limitation. The description clearly enables one skilled in the art to make and use the disclosure, describes several embodiments, adaptations, variations, alternative, and use of the disclosure, including what is presently believed to be the best mode of carrying out the disclosure.

The present disclosure provides a non-rectangular container that includes locking bottom panels, and a method for constructing the container. The container is constructed from a blank of sheet material. In the example embodiments, the container is at least partially formed using a machine. For example, the blank can be wrapped about a mandrel to form a knocked-down flat (KDF) container, and the final construction of the container can be performed by hand and/or by another machine. In one embodiment, the container is fabricated from a paperboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In the example embodiments, the non-rectangular container includes a plurality of bottom panels that interlock to form a bottom wall. More specifically, the bottom panels define a locking slot and a locking tab that is insertable into the locking slot for securing the bottom panels together. In particular embodiments, the non-rectangular container is octagonal-shaped and has four corner walls in addition to two side walls and two end walls (which may be collectively referred to as "side walls"). Moreover, in the example embodiments, the bottom panels are configured to abut or engage an interior surface of the side walls to reduce inward flexing. In other words, as explained below in more detail, the bottom panels are configured to engage the interior surface of the side walls to help prevent movement of the sidewalls relative to one another during handling and/or use of the erected container. Accordingly, the side walls are more stable compared to walls that are permitted to move relative to each other, which improves the integrity and stacking strength of the erected container. In addition, in one embodiment, the locking tab includes a pair of shoulders that improves the locking connection between bottom panels, which in turn reduces sagging of the bottom wall of the erected container.

In one embodiment, the container and/or a blank includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. In another embodiment, the container is void of markings, such as, without limitation, indicia that communicates the product, a manufacturer of the product and/or a seller of the product. Furthermore, the container may have any suitable size, shape and/or configuration, i.e., any suitable number of sides having any suitable size, shape and/or configuration as described and/or illustrated herein. In particular embodiments, the container includes a shape that provides functionality, such as a shape that facilitates packaging a food item, a shape that facilitates transporting the container, and/or a shape that facilitates stacking and/or arrangement of a plurality of containers.

Further, different embodiments described here can vary in size and/or dimensions although similar labels are used for each embodiment. For example, although a depth is labeled similarly throughout the description, each embodiment can have varying depths.

Turning now to the FIGS., FIG. 1 is a top plan view of an exemplary blank 100 of sheet material for forming a container 400 (shown in FIGS. 2-9). Blank 100 has a first or interior surface 102 and an opposing second or exterior surface 104. Further, blank 100 defines a leading edge 106 and an opposing trailing edge 108. In one embodiment, blank 100 includes, from leading edge 106 to trailing edge 108, a first corner panel 110, a first side panel 112, a second corner panel 114, a first end panel 116, a third corner panel 118, a second side panel 120, a fourth corner panel 122, a second end panel 124, and a glue flap 126 coupled together along preformed, generally parallel, fold lines 130, 132, 134, 136, 138, 140, 142, and 144, respectively. As described herein, any of end panels 116 and 124, side panels 112 and 120, and/or corner panels 110, 114, 118, and 122 may be collectively or generally referred to as "side panels". In the exemplary embodiment, corner panels 110, 114, 118, and 122 are each substantially congruent; however, it should be understood that corner panels 110, 114, 118, and/or 122 can each have any suitable size, shape, and/or configuration that enables blank 100 and/or container 400 to function as described herein.

First corner panel 110 extends from first side panel 112 along fold line 130 to leading edge 106, second corner panel 114 extends from first side panel 112 along fold line 132, first end panel 116 extends from second corner panel 114 along fold line 134, third corner panel 118 extends from first end panel 116 along fold line 136, second side panel 120 extends from third corner panel 118 along fold line 138, fourth corner panel 122 extends from second side panel 120 along fold line 140, second end panel 124 extends from fourth corner panel 122 along fold line 142, and glue flap 126 extends from second end panel 124 along fold line 144. Fold lines 130, 132, 134, 136, 138, 140, 142, and/or 144, as well as other fold lines and/or hinge lines described herein, may include any suitable line of weakening and/or line of separation known to those skilled in the art and guided by the teachings herein provided. It should be understood that, although not shown, blank 100 may include vent holes, cutouts, tabs, and/or any other additional features therein. In the illustrated embodiment, blank 100 includes a plurality of corrugated flutes oriented parallel to corrugation direction 148.

First side panel 112 includes a first top side panel 150 and a first bottom side panel 152 extending therefrom along respective fold lines 154 and 156. More specifically, first top side panel 150 extends from first side panel 112 along fold line 154, and first bottom side panel 152 extends from first side panel 112 along fold line 156.

In the illustrated embodiment, first top side panel 150 has a depth $D_1$ that is about half of a depth $D_2$ (shown in FIG. 8) of container 400. In addition, first top side panel 150 has a width $W_1$ that is wider than a width $W_2$ of first side panel 112. Alternatively, first top side panel 150 has any suitable depth and/or width that enables blank 100 and/or container 400 to function as described herein. In the illustrated embodiment, first top side panel 150 includes opposing side edges 158 and 160 and a free edge 162 extending between side edges 158 and 160. A first angled edge 164 extending from first side edge 158 and a second angled edge 166 extending from first angled edge 164 define a first top corner projection 168. A first offset edge 170 extends between second angled edge 166 and fold line 154 and is configured to offset first top corner projection 168 from fold line 154. Similarly, a third angled edge 172 extending from second side edge 160 and a fourth angled edge 174 extending from third angled edge 172 define a second top corner projection 176. A second offset edge 178 extends between fourth angled edge 174 and fold line 154 and is configured to offset second top corner projection 176 from fold line 154.

In the illustrated embodiment, first bottom side panel 152 has a depth $D_3$ that is more than about half of depth $D_2$ of container 400. Alternatively, first bottom side panel 152 has any suitable depth that enables blank 100 and/or container 400 to function as described herein. First bottom side panel 152 has a first angled side edge 180 and an opposing second angled side edge 182. A first shoulder edge 184 extends from first angled side edge 180 substantially parallel to fold line 156, and a second shoulder edge 186 extends from second angled side edge 182 substantially parallel to fold line 156. First shoulder edge 184 and first angled side edge 180 define a first shoulder projection 188, and, similarly, second shoulder edge 186 and second angled side edge 182 define a second shoulder projection 190. A first tab edge 192 extends from first shoulder edge 184, and an opposing second tab edge 194 extends from second shoulder edge 186. A free edge 196 extends between first and second tab edges 192, 194. Tab edges 192, 194 and free edge 196 define a locking tab 198. Locking tab 198 has a width $W_3$. A first shoulder joint 189 is defined by first shoulder projection 188 and locking tab 198, and a second shoulder joint 191 is defined by second shoulder projection 190 and locking tab 198.

Similarly, second side panel 120 includes a second top side panel 200 and a second bottom side panel 202 extending therefrom along respective fold lines 204 and 206. More specifically, second top side panel 200 extends from second side panel 120 along fold line 204, and second bottom side panel 202 extends from second side panel 120 along fold line 206.

In the illustrated embodiment, second top side panel 200 has a depth $D_4$ that is about half of depth $D_2$ of container 400 and a width $W_4$ that is wider than a width $W_5$ of second side panel 120. Moreover, second top side panel 200 is substantially congruent to first top side panel 150, such that depth $D_4$ is substantially equal to depth $D_1$ and width $W_4$ is substantially equal to width $W_1$. Alternatively, second top side panel 200 has any suitable depth and/or width that enables blank 100 and/or container 400 to function as described herein. In the illustrated embodiment, second top side panel 200 include opposing side edges 208 and 210 and a free edge 212 extending between side edges 208 and 210. A first angled edge 214 extending from first side edge 208 and a second angled edge 216 extending from first angled edge 214 define a third top corner projection 218. A third offset edge 220 extends between second angled edge 216 and fold line 204 and is configured to offset third top corner projection 218 from fold line 204. Similarly, a third angled edge 222 extending from second side edge 210 and a fourth angled edge 224 extending from third angled edge 222 define a fourth top corner projection 226. A fourth offset edge 228 extends between fourth angled edge 224 and fold line 204 and is configured to offset fourth top corner projection 226 from fold line 204.

In the illustrated embodiment, second bottom side panel 202 has a depth $D_5$ that is more than about half of depth $D_2$ of container 400. Alternatively, second bottom side panel 202 has any suitable depth that enables blank 100 and/or container 400 to function as described herein. Second bottom side panel 202 includes opposing side edges 230, 232 and a free edge 233 extending between side edges 230, 232. First side edge 230 has a length $L_1$ that is less than or equal to a width $W_8$ of first end panel 116, and second side edge has a length $L_2$ that is less than or equal to a width $W_{10}$ of second end panel 124, as described further herein. Free edge 233 includes a first horizontal portion 234, a first vertical portion 236, a second horizontal portion 238, a second vertical portion 240, and a third horizontal portion 242. First vertical portion 236, second horizontal portion 238, and second vertical portion 240 define a locking indentation 244.

In addition, first horizontal portion 234, first vertical portion 236, and first side edge 230 define a first locking extension 246. Second vertical portion 240, third horizontal portion 242, and second side edge 232 define a second locking extension 248. In the illustrated embodiment, locking indentation 244 has a width $W_6$ that is congruent to width $W_3$ of locking tab 198 and a depth $D_6$ that is congruent to a depth $D_7$ of locking tab 198.

Additionally, a first angled edge 250 (also referred to herein as "first engagement member 250") extends from first side edge 230, and a second angled edge 252 (also referred to herein as "second engagement member 252") extends from second side edge 232. A first offset edge 254 extends from first angled edge 250 to fold line 206, and a second offset edge 256 extends from second angled edge 252 to fold line 206. First and second offset edges 254, 256 are configured to offset angled edges 250, 252 from fold line 206. In the illustrated embodiment, each angled edge 250, 252 is congruent and has a length $L_3$. As described further herein, length $L_3$ is congruent with a width $W_{11}$ of corner panels 110, 114, 118, and 122.

First end panel 116 includes a first top end panel 260 and a first bottom end panel 262 extending therefrom along respective fold lines 264 and 266. More specifically, first top end panel 260 extends from first end panel 116 along fold line 264, and first bottom end panel 262 extends from first end panel 116 along fold line 266.

In the illustrated embodiment, first top end panel 260 has a width $W_7$ that is greater than a width $W_8$ of first end panel 116 and a depth $D_8$. Alternatively, first top end panel 260 has any suitable depth and/or width that enables blank 100 and/or container 400 to function as described herein. First top end panel 260 includes opposing side edges 268, 270 and a free edge 272 extending between side edges 268, 270. A first angled edge 274 extends from first side edge 268, and a second angled edge 276 extends from second side edge 270. A fifth offset edge 278 extends from first angled edge 274 to fold line 264 and is configured to offset first angled edge 274 from fold line 264. A sixth offset edge 280 extends from second angled edge 276 to fold line 264 and is configured to offset second angled edge 276 from fold line 264.

First bottom end panel 262 includes a first side edge 282, an opposing second side edge 284, and a free edge 286 extending therebetween. In the illustrated embodiment, as described further herein, first side edge 282 has a length $L_4$ that is less than or equal to about half of width $W_2$ of first side panel 112. A first angled edge 288 (also referred to herein as "first engagement member 288") extends from first side edge 282, and a third offset edge 290 extends between first angled edge 288 and fold line 266. Third offset edge 290 is configured to offset first angled edge 288 from fold line 266. In the illustrated embodiment, first angled edge 288 is congruent with first and second angled edges 250, 252 of second bottom side panel 202, such that first angled edge 288 of first bottom end panel 262 has length $L_3$. In addition, a second angled edge 292 extends from second side edge 284 to fold line 266. First side edge 282, free edge 286, and second side edge 284 define a third locking extension 294.

Similarly, second end panel 124 includes a second top end panel 300 and a second bottom end panel 302 extending therefrom along respective fold lines 304 and 306. More specifically, second top end panel 300 extends from second end panel 124 along fold line 304, and second bottom end panel 302 extends from second end panel 124 along fold line 306.

In the illustrated embodiment, second top end panel 300 has a width $W_9$ that is greater than width $W_{10}$ of second end panel 124 and a depth $D_9$. Moreover, second top end panel 300 is substantially congruent to first top end panel 260, such that depth $D_9$ is substantially equal to depth $D_8$ and width $W_9$ is substantially equal to width $W_7$. Alternatively, second top end panel 300 has any suitable depth and/or width that enables blank 100 and/or container 400 to function as described herein. Second top end panel 300 includes opposing side edges 308, 310 and a free edge 312 extending between side edges 308, 310. A first angled edge 314 extends from first side edge 308, and a second angled edge 316 extends from second side edge 310. A seventh offset edge 318 extends from first angled edge 314 to fold line 304 and is configured to offset first angled edge 314 from fold line 304. An eighth offset edge 320 extends from second angled edge 316 to fold line 304 and is configured to offset second angled edge 316 from fold line 304.

Second bottom end panel 302 is substantially a mirror-image of first bottom end panel 262 and includes a first side edge 322, an opposing second side edge 324, and a free edge 326 extending therebetween. In the illustrated embodiment, as described further herein, first side edge 322 has a length $L_5$ that is less than or equal to about half of width $W_2$ of first side panel 112. A first angled edge 328 (also referred to herein as "first engagement member 328") extends from first side edge 322, and a fourth offset edge 330 extends between first angled edge 328 and fold line 306. Fourth offset edge 330 is configured to offset first angled edge 328 from fold line 306. In the illustrated embodiment, first angled edge 328 is congruent with first and second angled edges 250, 252 of second bottom side panel 202, such that first angled edge 328 of second bottom end panel 302 has length $L_3$. In addition, a second angled edge 332 extends from second side edge 324 to fold line 306. First side edge 322, free edge 326, and second side edge 324 define a fourth locking extension 334.

In addition, in the illustrated embodiment, blank 100 includes a plurality of machine cutouts 340, 342, 344. Each machine cutout 340, 342, 344 spaces a bottom panel 152, 202, 262, 302 from an adjacent bottom panel 152, 202, 262, 302. When any blank 100 is fabricated from a larger piece of sheet material, blank 100 must be cut to the size and shape necessary to form a container 400. Providing machine cutouts 340, 342, 344 that space apart adjacent bottom panels 152, 202, 262, 302 facilitates improvement in processing speeds for fabricating blank 100 over fabricating blanks with more complex relationships between bottom panels by simplifying a die-cutting process thereof.

Figure 2:
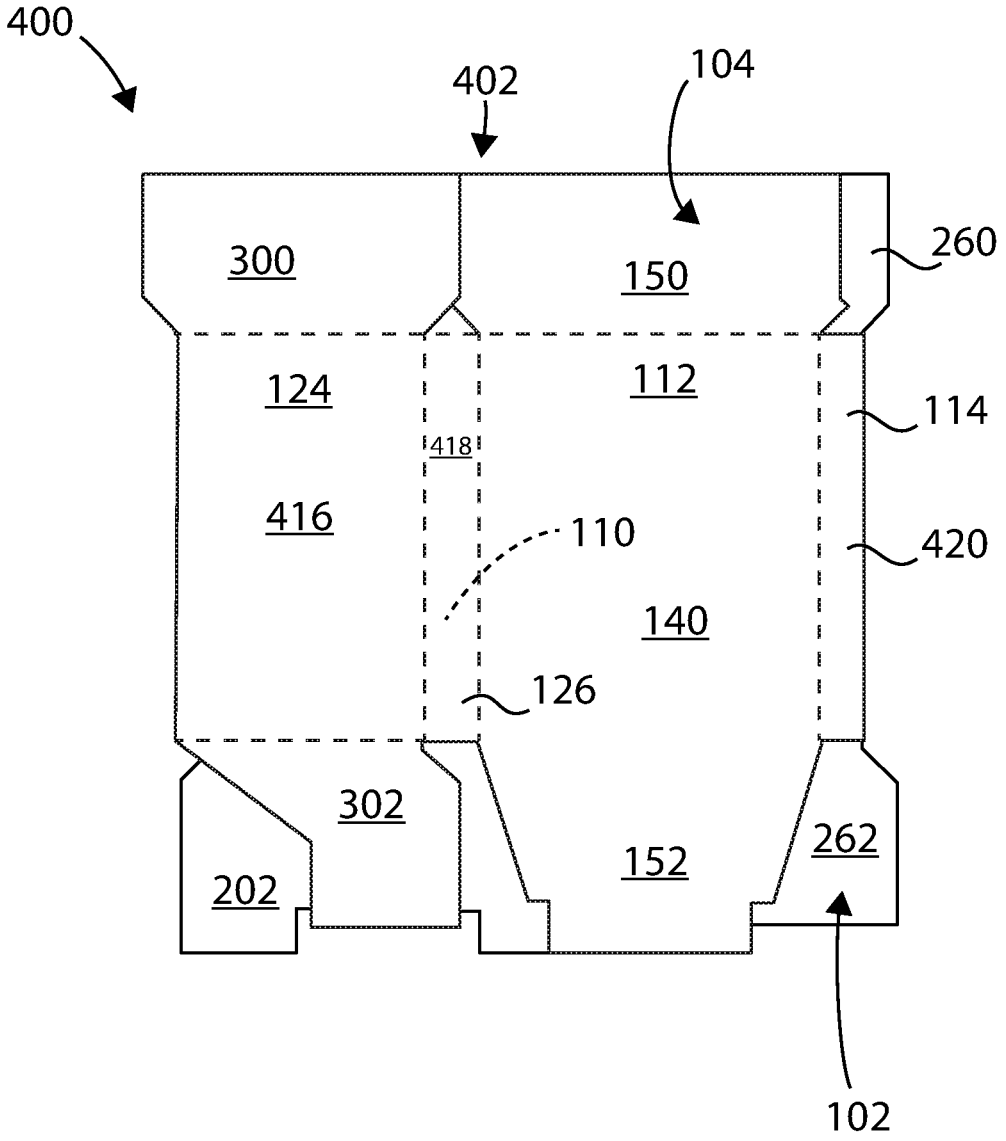
Figure 3:
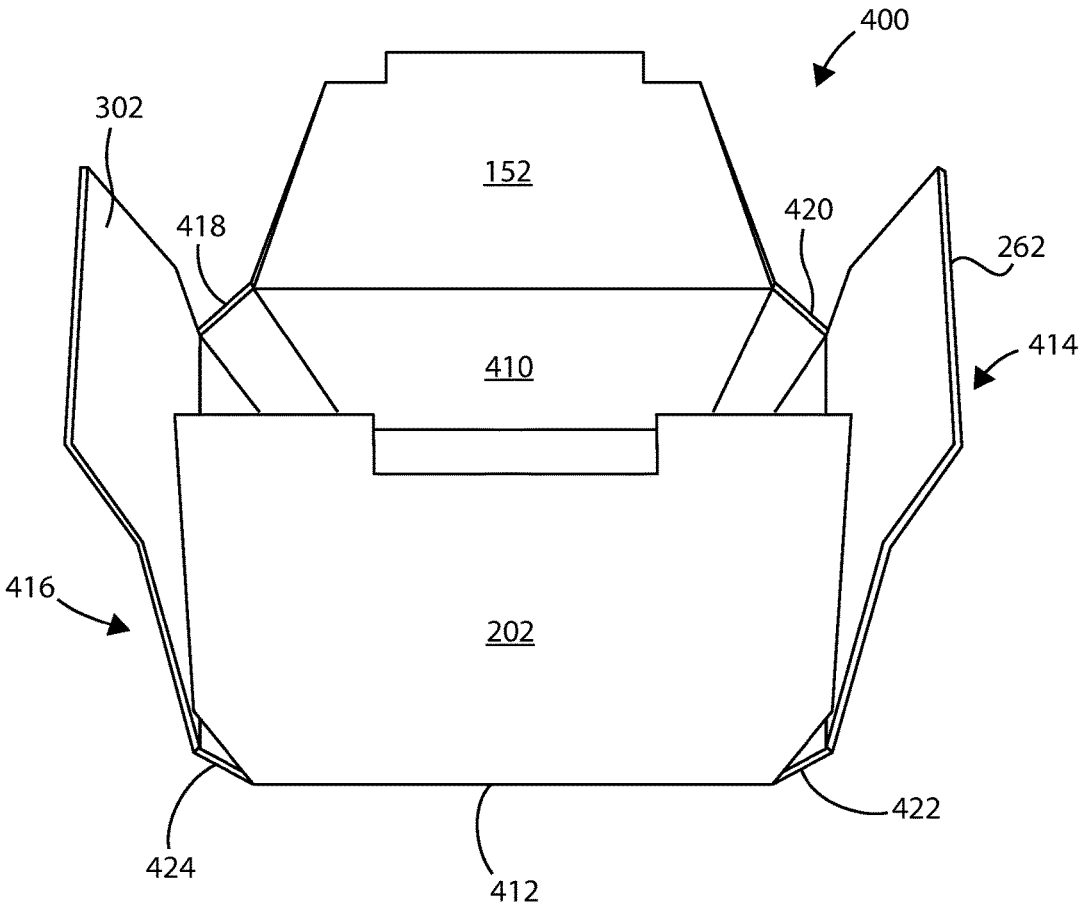
Figure 4:
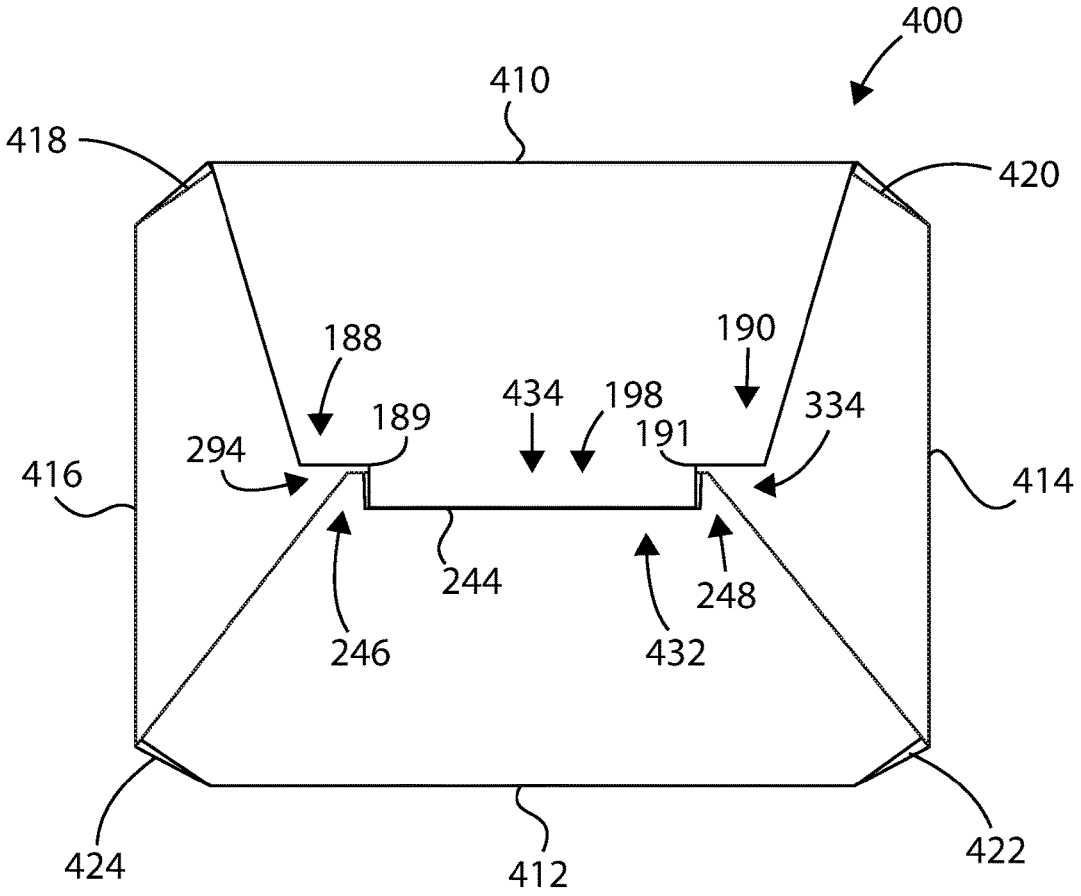
Figure 5:
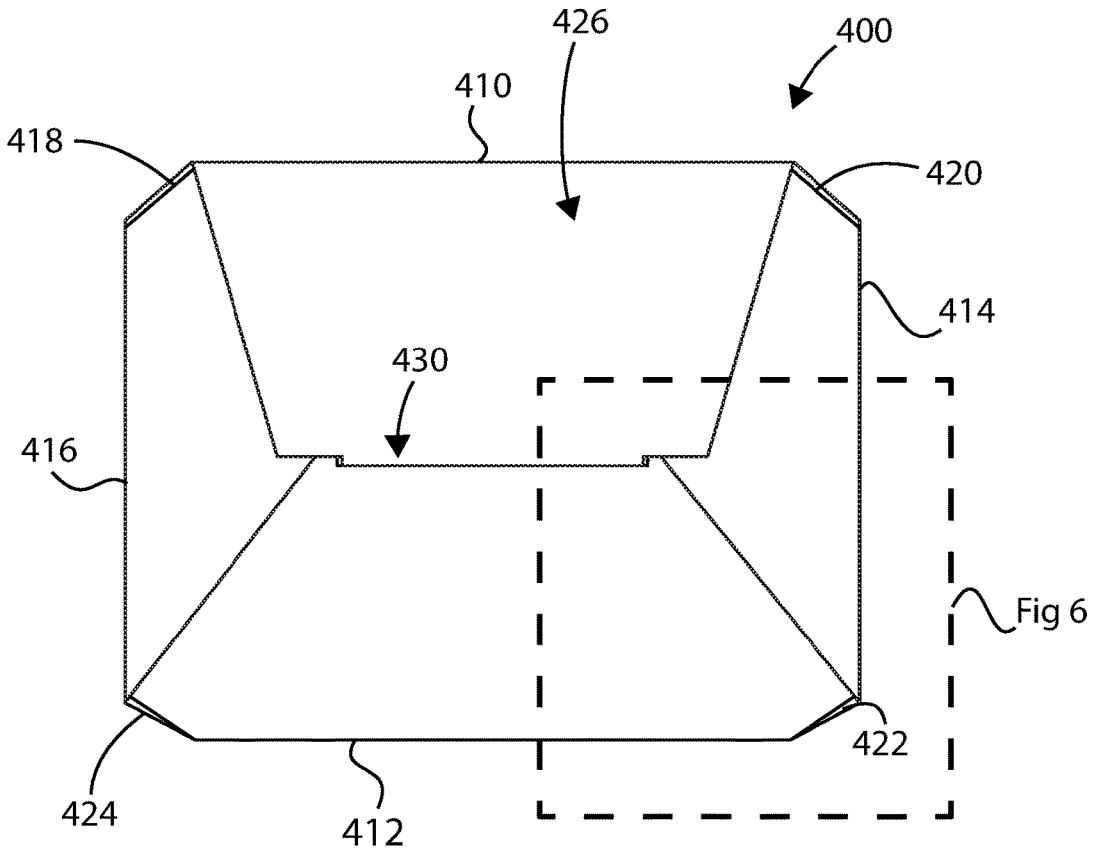
Figure 6:
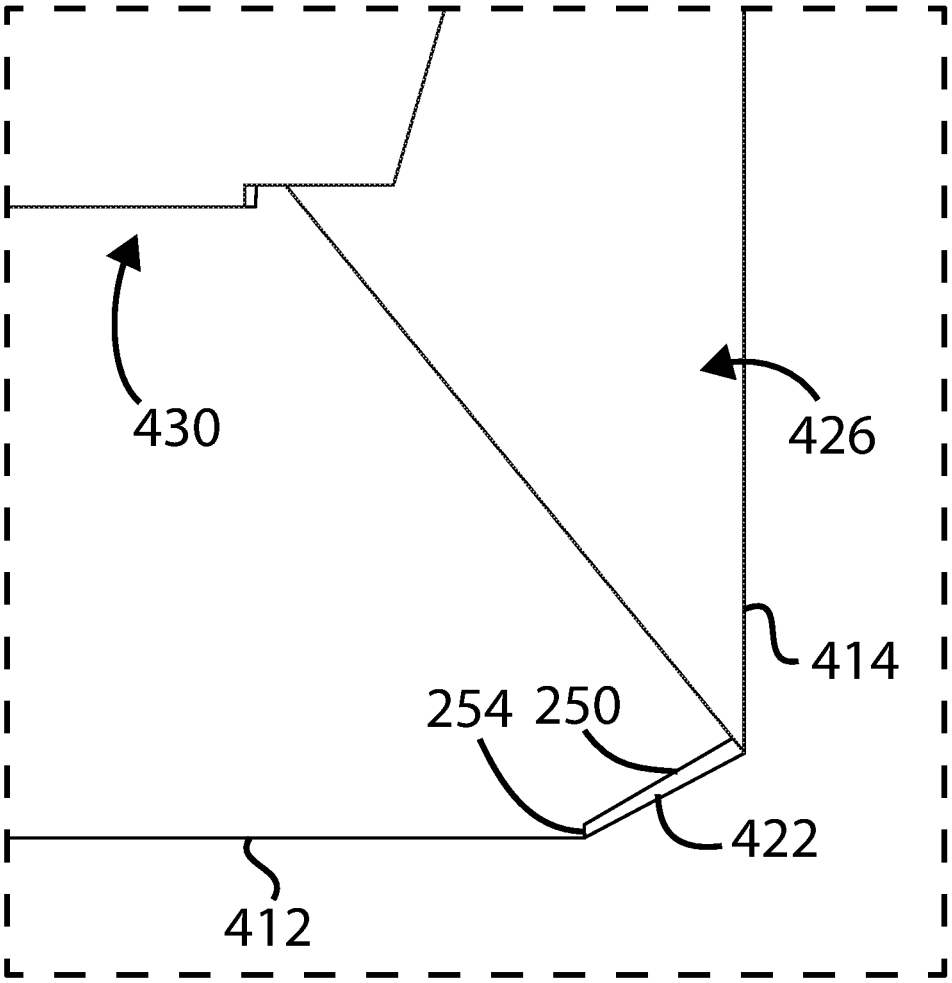
Figure 7:
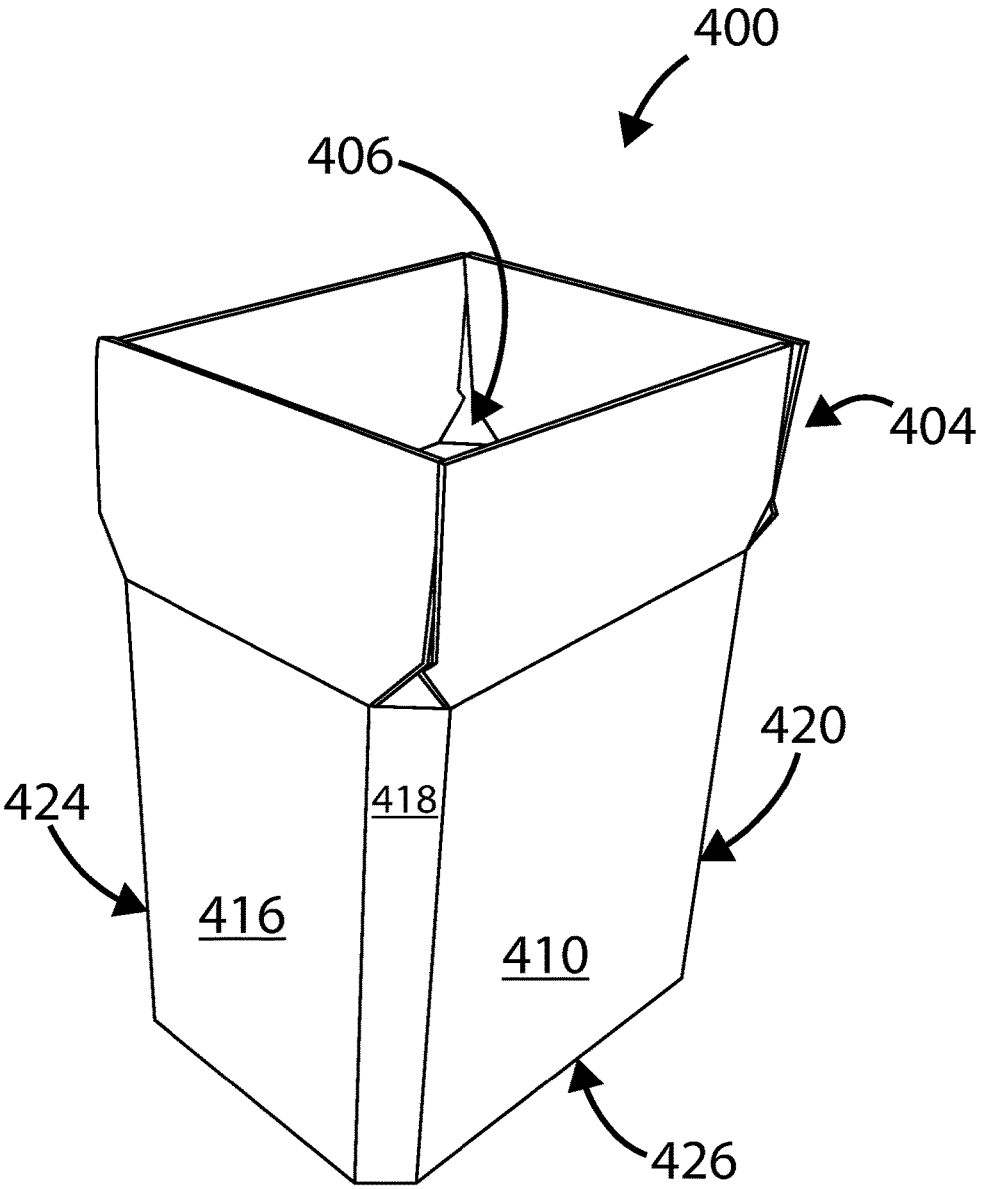
Figure 8:
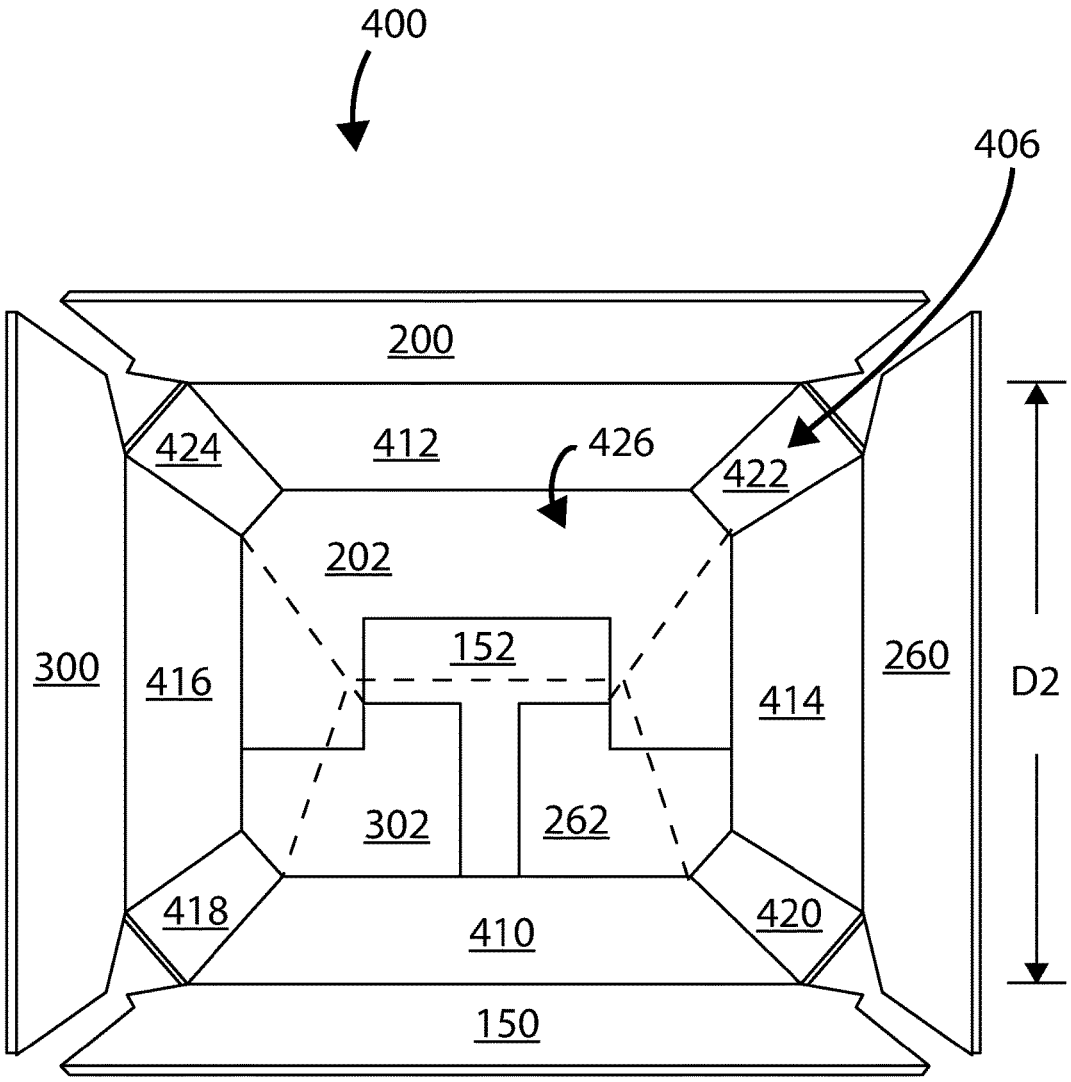
Figure 9:
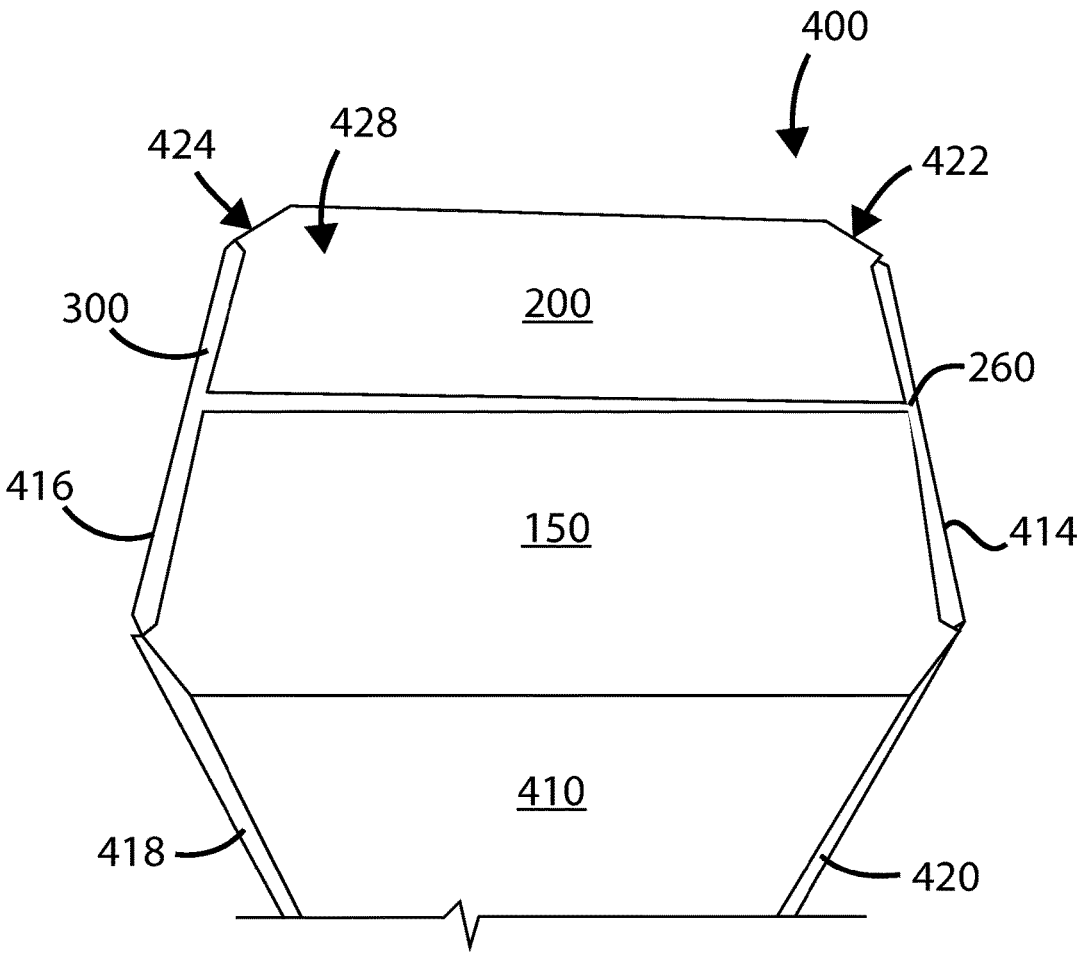

FIGS. 2-9 depict various views of container 400 in various stages of formation. More particularly, FIG. 2 is a top perspective view of a partially formed container 400 in a knocked-down-flat configuration 402. FIGS. 3-5 are bottom perspective views of the partially formed container 400 shown in FIG. 2 illustrating formation of a bottom wall 426 of container 400 to transition container 400 into an open configuration 404. FIG. 6 is an enlarged view of the bottom wall 426. FIG. 7 is a perspective view of container 400 shown in open configuration 404. FIG. 8 is a top perspective view of interior surface 102 of container 400 in open configuration 404. FIG. 9 is a top perspective view of a top wall 428 of container 400. Reference numerals in the "100s", "200s", and "300s" reference elements of blank 100, whereas reference numerals in the "400s" reference elements of container 400.

To construct container 400 from blank 100, first corner panel 110 is rotated about fold line 130 toward interior surface 102 of first side panel 112, first side panel 112 is rotated about fold line 132 toward interior surface 102 of second corner panel 114, second corner panel 114 is rotated about fold line 134 toward interior surface 102 of first end panel 116, first end panel 116 is rotated about fold line 136 toward interior surface 102 of third corner panel 118, third corner panel 118 is rotated about fold line 138 toward interior surface 102 of second side panel 120, second side panel 120 is rotated about fold line 140 toward interior surface 102 of fourth corner panel 122, fourth corner panel 122 is rotated about fold line 142 toward interior surface 102 of second end panel 124, and glue flap 126 is rotated about fold line 144 toward interior surface 102 of second end panel 124.

In the illustrated embodiment, after rotating panels 110, 112, 114, 116, 118, 120, 122, and 124, and glue flap 126 about fold lines 130, 132, 134, 136, 138, 140, 142, and 144, side panels 112 and 120 are substantially parallel to each other and substantially perpendicular to end panels 116 and 124; and first corner panel 110, glue flap 126, and third corner panel 118 are substantially parallel to each other and substantially perpendicular to second corner panel 114 and fourth corner panel 122. Panels 110, 112, 114, 116, 118, 120, 122, and 124, and glue flap 126 can be rotated about fold lines 130, 132, 134, 136, 138, 140, 142, and 144 by hand or by wrapping blank 100 about a mandrel within a machine.

Once panels 110, 112, 114, 116, 118, 120, 122, and 124, and glue flap 126 are rotated about fold lines 130, 132, 134, 136, 138, 140, 142, and 144, glue flap 126 is coupled to first corner panel 110. For example, in the illustrated embodiment, interior surface 102 of glue flap 126 is adhered to exterior surface 104 of first corner panel 110. Alternatively, exterior surface 104 of glue flap 126 is adhered to interior surface 102 of first corner panel 110. Further, although adhesive is described herein, glue flap 126 can be coupled to first corner panel 110 using any suitable fastener and/or technique. From this configuration, partially formed container 400 can be collapsed into a knocked-down-flat (KDF) configuration 402, as shown in FIG. 2.

In the illustrated embodiment, once glue flap 126 is coupled to first corner panel 110, first side panel 112 forms a first side wall 410 of container 400, and second side panel 120 forms a second side wall 412 of container 400. First end panel 116 forms a first end wall 414, and second end panel 124 forms a second end wall 416. First corner panel 110 and glue flap 126 form a first corner wall 418, second corner panel 114 forms a second corner wall 420, third corner panel 118 forms a third corner wall 422, and fourth corner panel 122 forms a fourth corner wall 424. Side walls 410 and 412, end walls 414 and 416, and/or corner walls 418, 420, 422, and 424 may be collectively or generally referred to as "side walls".

To transition container 400 from KDF configuration 402 to an open configuration 404 (shown in FIG. 7), a bottom wall 426 of container 400 is formed. More specifically, second bottom side panel 202 is rotated about fold line 206 toward interior surface 102 of second side panel 120 into a substantially perpendicular relationship with second side panel 120. This rotation positions first engagement member ("angled edge") 250 of second bottom side panel 202 in an abutting, edge-to-face relationship with interior surface 102 of third corner panel 118. In other words, first engagement member 250 of second bottom side panel 202 engages interior surface 102 of third corner wall 422 to reduce inward flexing of third corner wall 422. By engaging interior surface 102 of third corner wall 422, engagement member 250 helps to prevent movement of third corner wall 422 relative to side walls 410, 412, 414, 416, 418, 420, and/or 424. Such movement would cause container 400 to lose its properly aligned shape and reduce its stacking strength and/or stability. Similarly, second engagement member ("angled edge") 252 of second bottom side panel 202 is positioned in an abutting, edge-to-face relationship with interior surface 102 of fourth corner panel 122. Second engagement member 252 of second bottom side panel 202 engages interior surface 102 of fourth corner wall 424 to reduce inward flexing of fourth corner wall 424 and help prevent movement of fourth corner wall 424 relative to side walls 410, 412, 414, 416, 418, 420, and/or 422.

Moreover, first side edge 230 (which is further referred to herein as "third engagement member 230") of second bottom side panel 202 is positioned in an abutting, edge-to-face relationship with interior surface 102 of first end panel 116. Third engagement member 230 of second bottom side panel 202 engages interior surface 102 of first end wall 414 to reduce inward flexing of first end wall 414 and help prevent movement of first end wall 414 relative to side walls 410, 412, 416, 418, 420, 422, and/or 424. Similarly, second side edge 232 (which is further referred to herein as "fourth engagement member 232") of second bottom side panel 202 is positioned in an abutting, edge-to-face relationship with interior surface of second end panel 124. Fourth engagement member 232 of second bottom side panel 202 engages interior surface 102 of second end wall 416 to reduce inward flexing of second end wall 416 and help prevent movement of second end wall 416 relative to side walls 410, 412, 416, 418, 420, 422, and/or 424.

First bottom end panel 262 is rotated about fold line 266 toward interior surface 102 of first end panel 116 and into a face-to-face relationship with second bottom side panel 202. More specifically, interior surface 102 of first bottom end panel 262 is directly adjacent to and/or in direct contact with exterior surface 104 of second bottom side panel 202. This rotation positions first engagement member ("angled edge") 288 of first bottom end panel 262 in an abutting, edge-to-face relationship with interior surface 102 of second corner panel 114. In other words, first engagement member 288 of first bottom end panel 262 engages interior surface 102 of second corner wall 420 to reduce inward flexing of second corner wall 420 and help prevent movement of second corner wall 420 relative to side walls 410, 412, 414, 416, 418, 422, and/or 424. In addition, first side edge 282 (which is further referred to herein as "second engagement member 282") of first bottom end panel 262 is positioned in an abutting, edge-to-face relationship with interior surface 102 of first side panel 112. Second engagement member 282 of first bottom end panel 262 engages interior surface 102 of first side wall 410 to reduce inward flexing of first side wall 410 and help prevent movement of first side wall 410 relative to side walls 412, 414, 416, 418, 420, 422, and/or 424.

Second bottom end panel 302 is rotated about fold line 306 toward interior surface 102 of second end panel 124 and into a face-to-face relationship with second bottom side panel 202. More specifically, interior surface 102 of second bottom end panel 302 is directly adjacent to and/or in direct contact with exterior surface 104 of second bottom side panel 202. This rotation positions first engagement member ("angled edge") 328 of second bottom end panel 302 in an abutting, edge-to-face relationship with interior surface 102 of first corner panel 110 (or glue flap 126). In other words, first engagement member 328 of second bottom end panel 302 engages interior surface 102 of first corner wall 418 to reduce inward flexing of first corner wall 418 and help prevent movement of first corner wall 418 relative to side walls 410, 412, 414, 416, 420, 422, and/or 424. In addition, first side edge 322 (which is further referred to herein as "second engagement member 322") of second bottom end panel 302 is positioned in an abutting, edge-to-face relationship with interior surface 102 of first side panel 112. Second engagement member 322 of second bottom end panel 302 engages interior surface 102 of first side wall 410 to reduce inward flexing of first side wall 410 and help prevent movement of first side wall 410 relative to side walls 412, 414, 416, 418, 420, 422, and/or 424.

In the illustrated embodiment of container 400, a bottom locking mechanism 430 includes locking tab 198, shoulder projections 188 and 190, shoulder joints 189 and 191, locking indentation 244, and locking extensions 246, 248, 294, and 334. Locking indentation 244 and locking extensions 246, 248, 294, and 334 define a locking slot 432, shown in FIG. 4. Alternatively, bottom locking mechanism 430 may include any suitable components and/or configuration that enables container 400 to be formed from blank 100.

First bottom side panel 152 is then rotated about fold line 156 toward interior surface 102 of first side panel 112. First bottom side panel 152 is rotated toward second bottom side panel 202 and bottom end panels 262 and 302 until panels 152, 202, 262, and 302 are rotated slightly upwardly into container 400. More specifically, panels 152, 202, 262, and 302 are rotated such that locking tab 198 can be inserted into locking slot 432 in the direction indicated by arrow 434. Locking tab 198 is inserted into locking slot 432 until shoulder joints 189, 191 abut second horizontal portion 238 of free edge 233 of second bottom side panel 202. Shoulder joints 189, 191 are configured to improve locking mechanism 430 in comparison to alternative locking mechanisms by enhancing the locking connection between locking tab 198 and locking indentation 244. Once locking tab 198 is inserted into locking slot 432, panels 152, 202, 262, and 302 rotate or settle outwardly to be substantially perpendicular to panels 110, 112, 114, 116, 118, 120, 122, and 124, and glue flap 126. When bottom panels 152, 202, 262, and 302 are in the substantially perpendicular configuration, bottom panels 152, 202, 262, and 302 are locked together to form bottom wall 426 of container 400. Locking mechanism 430 is configured to interlock bottom side panels 152 and 202 and bottom end panels 262 and 302 to form bottom wall 426 and maintain the integrity of bottom wall 426 under heavier loads (e.g., heavier products in container 400) and/or during handling of container 400 (e.g., during packing, shipping, storage) by reducing inward or outward flexing of bottom wall 426.

Moreover, as shown in FIGS. 5 and 6, when bottom wall 426 is formed and locked via locking mechanism 430, corner walls 418, 420, 422, and 424 have improved stability from the respective engagement members 328, 288, 250, and 252 of bottom panels 302, 262, and 202 engaged therewith. In particular, as best seen in FIG. 6, corresponding offset edges 330, 290, 254, and 256 facilitate the edge-to-face relationships between engagement members 328, 288, 250, and 252 of bottom panels 302, 262, and 202 and corner walls 418, 420, 422, and 424. Additionally, end walls 414 and 416 have improved stability from the respective side edges 230 and 232 of second bottom side panel 202 coupled thereagainst. In other words, by configuring bottom panels 152, 202, 262, and 202 as described herein, corner walls 418, 420, 422, and 424, end walls 414 and 416, and bottom wall 426 have improved stability over containers formed from blanks without engagement members 328, 288, 250, 252, 230, and 232 of corresponding bottom panels.

When container 400 is transitioned to open configuration 404 (shown in FIGS. 7 and 8), side walls 410 and 412, end walls 414 and 416, corner walls 418, 420, 422, and 424, and bottom wall 426 define a cavity 406 of container 400. To close container 400 by forming top wall 428 as shown in FIG. 9, first top end panel 260 is rotated about fold line 264 toward interior surface 102 of first end panel 116. More specifically, after rotation, first top end panel 260 is substantially perpendicular to first end panel 116. This rotation positions first angled edge ("first engagement member") 274 of first top end panel 260 in an abutting, edge-to-face relationship with second corner panel 114. In other words, first engagement member 274 of first top end panel 260 engages interior surface 102 of second corner wall 420 to further reduce inward flexing of second corner wall 420 and further prevent movement of second corner wall 420 relative to side walls 410, 412, 414, 416, 418, 422, and/or 424. Similarly, second angled edge ("second engagement member") 276 of first top end panel 260 is positioned in an abutting, edge-to-face relationship with interior surface 102 of third corner panel 118. Second engagement member 276 of first top end panel 260 engages interior surface 102 of third corner wall 422 to further reduce inward flexing of third corner wall 422 and further prevent movement of third corner wall 422 relative to side walls 410, 412, 414, 416, 418, 420, and/or 424.

In addition, first side edge ("third engagement member") 268 of first top end panel 260 is positioned in an abutting, edge-to-face relationship with interior surface 102 of first side panel 112. Third engagement member 268 engages interior surface 102 of first side wall 410 to reduce inward flexing of first side wall 410 and help prevent movement of first side wall 410 relative to side walls 412, 414, 416, 418, 420, 422, and/or 424. Second side edge ("fourth engagement member") 270 of first top end panel 260 is positioned in an abutting, edge-to-face relationship with interior surface 102 of second side panel 120. Fourth engagement member 270 engages interior surface 102 of second side wall 412 to further reduce inward flexing of second side wall 412 and further prevent movement of second side wall 412 relative to side walls 410, 414, 416, 418, 420, 422, and/or 424.

Similarly, second top end panel 300 is rotated about fold line 304 toward interior surface 102 of second end panel 124. More specifically, after rotation, second top end panel 300 is substantially perpendicular to second end panel 124. This rotation positions first angled edge ("first engagement member") 314 of second top end panel 300 in an abutting, edge-to-face relationship with interior surface 102 of fourth corner panel 122. In other words, first engagement member 314 of second top end panel 300 engages interior surface 102 of fourth corner wall 424 to further reduce inward flexing of fourth corner wall 424 and further prevent movement of fourth corner wall 424 relative to side walls 410, 412, 414, 416, 418, 420, and/or 422. Similarly, second angled edge ("second engagement member") 316 of second top end panel 300 is positioned in an abutting, edge-to-face relationship with interior surface 102 of first corner panel 110 (or glue flap 126). Second engagement member 316 of second top end panel 300 engages interior surface 102 of first corner wall 418 to further reduce inward flexing of first corner wall 418 and further prevent movement of first corner wall 418 relative to side walls 410, 412, 414, 416, 420, 422, and/or 424.

In addition, first side edge ("third engagement member") 308 of second top end panel 300 is positioned in an abutting, edge-to-face relationship with interior surface 102 of second side panel 120. Third engagement member 308 engages interior surface 102 of second side wall 412 to reduce inward flexing of second side wall 412 and help prevent movement of second side wall 412 relative to side walls 410, 414, 416, 418, 420, 422, and/or 424. Second side edge ("fourth engagement member") 310 of second top end panel 300 is position in an abutting, edge-to-face relationship with interior surface 102 of first side panel 112. Fourth engagement member 310 engages interior surface of first side wall 410 to reduce inward flexing of first side wall 410 and help prevent movement of first side wall 410 relative to side walls 412, 414, 416, 418, 420, 422, and/or 424.

Subsequently, first top side panel 150 is rotated about fold line 154 toward interior surface 102 of first side panel 112, and second top side panel 200 is rotated about fold line 204 toward interior surface 102 of second side panel 120. More specifically, after rotation, first top side panel 150 is substantially perpendicular to first side panel 112, and second top side panel 200 is substantially perpendicular to second side panel 120. In the illustrated embodiment, top side panels 150 and 200 do not overlap each other when top side panels 150 and 200 are substantially parallel to bottom wall 426. In an alternative embodiment, top side panels 150 and 200 are sized such that top side panels 150 and 200 overlap each other when top side panels 150 and 200 are parallel to bottom wall 426. Moreover, in the illustrated embodiment, top side panels 150 and 200 rest upon top end panels 260 and 300 when top wall 428 is formed therefrom. As such, interior surface 102 of top side panels 150 and/or 200 is adjacent to and/or in direct contact with exterior surface 104 of top end panels 260 and/or 300.

Accordingly, when top wall 428 is formed, corner walls 418, 420, 422, and 424 have improved stability from the respective engagement members 316, 274, 276, and 314 of top end panels 260 and 300 engaged therewith. In particular, corresponding offset edges 320, 278, 280, and 318 facilitate the edge-to-face relationships between engagement members 316, 274, 276, and 314 of top end panels 260 and 300 and corner walls 418, 420, 422, and 424. Additionally, side walls 410 and 412 have improved stability from the respective engagement members 268 and 270 of first top end panel 260 and engagement members 310 and 308 of second top end panel 300 engaged therewith. In other words, by configuring top panels 260 and 300 as described herein, side walls 410, 412, 418, 420, 422, and 424 have improved stability over containers formed from blanks without engagement members 316, 274, 276, 314, 268, 270, 310, and 308 of corresponding top panels.

Figure 10:
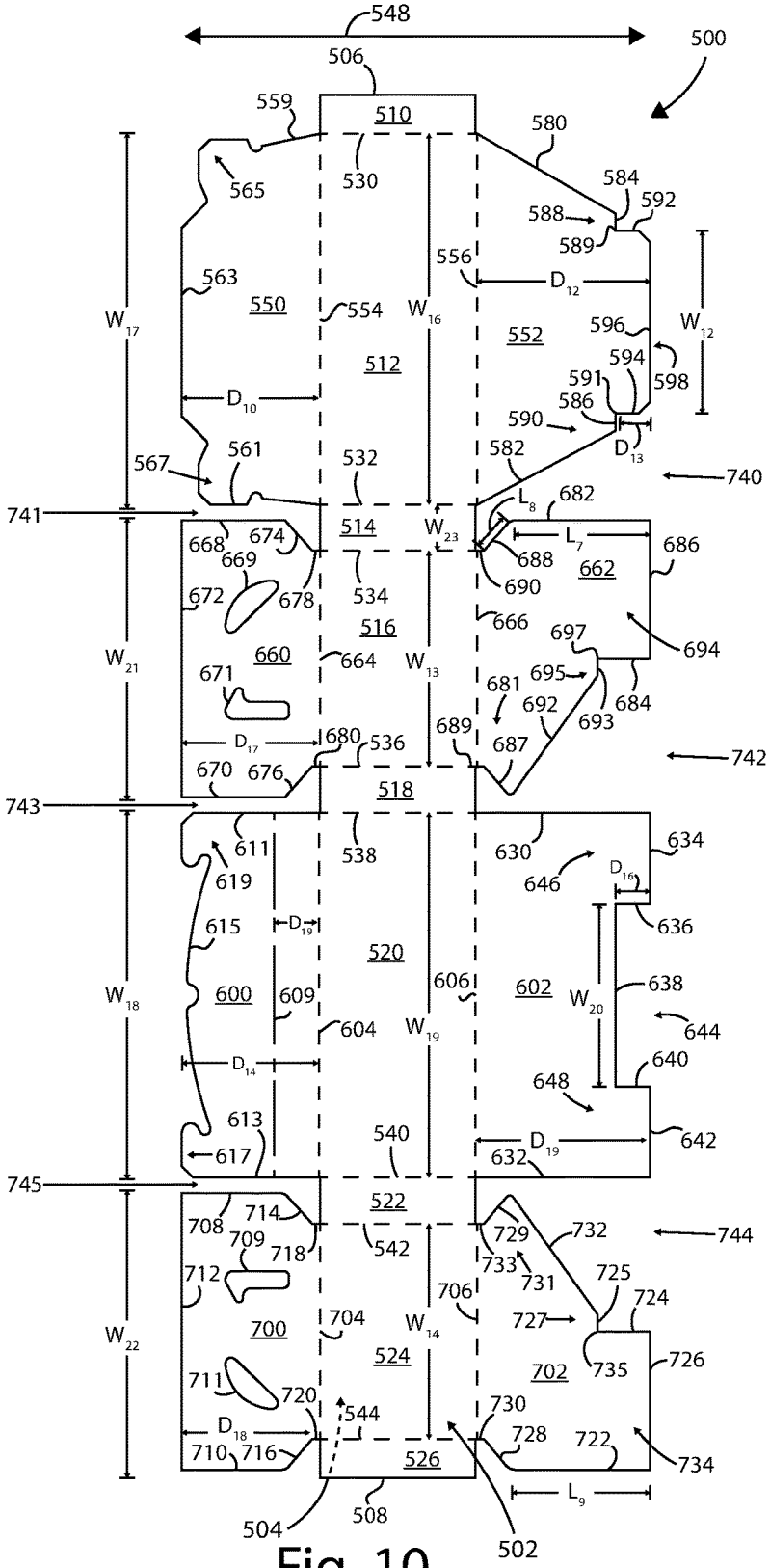

FIG. 10 is a top plan view of an exemplary blank 500 of sheet material for forming a container 800 (shown in FIGS. 11-20) according to a second embodiment. Blank 500 has a first or interior surface 502 and an opposing second or exterior surface 504. Further, blank 500 defines a leading edge 506 and an opposing trailing edge 508. In the illustrated embodiment, blank 500 includes, from leading edge 506 to trailing edge 508, a first corner panel 510, a first side panel 512, a second corner panel 514, a first end panel 516, a third corner panel 518, a second side panel 520, a fourth corner panel 522, a second end panel 524, and a glue flap 526 coupled together along preformed, generally parallel, fold lines 530, 532, 534, 536, 538, 540, 542, and 544, respectively. As described herein, any of end panels 516 and 524, side panels 512 and 520, and/or corner panels 510, 514, 518, and 522 may be collectively or generally referred to as "side panels". In the exemplary second embodiment, corner panels 510, 514, 518, and 522 are each substantially congruent; however, it should be understood that corner panels 510, 514, 518, and/or 522 can each have any suitable size, shape, and/or configuration that enables blank 500 and/or container 800 to function as described herein.

First corner panel 510 extends from first side panel 512 along fold line 530 to leading edge 506, second corner panel 514 extends from first side panel 512 along fold line 532, first end panel 516 extends from second corner panel 514 along fold line 534, third corner panel 518 extends from first end panel 516 along fold line 536, second side panel 520 extends from third corner panel 518 along fold line 538, fourth corner panel 522 extends from second side panel 520 along fold line 540, second end panel 524 extends from fourth corner panel 522 along fold line 542, and glue flap 526 extends from second end panel 524 along fold line 544. Fold lines 530, 532, 534, 536, 538, 540, 542, and/or 544, as well as other fold lines and/or hinge lines described herein, may include any suitable line of weakening and/or line of separation known to those skilled in the art and guided by the teachings herein provided. It should be understood that, although not shown, blank 500 may include vent holes, cutouts, tabs, and/or any other additional features therein. In the illustrated embodiment, blank 500 includes a plurality of corrugated flutes oriented parallel to corrugation direction 548.

First side panel 512 includes a first top side panel 550 and a first bottom side panel 552 extending therefrom along respective fold lines 554 and 556. More specifically, first top side panel 550 extends from first side panel 512 along fold line 554, and first bottom side panel 552 extends from first side panel 512 along fold line 556.

In the illustrated second embodiment, first top side panel 550 has a depth $D_{10}$ that is about half of a depth $D_{11}$ (shown in FIG. 16) of container 800. In addition, first top side panel 550 has a width $W_{17}$ that is about equal to width $W_{16}$ of first side panel 512. Alternatively, first top side panel 550 has any suitable depth and/or width that enables blank 500 and/or container 800 to function as described herein. In the illustrated second embodiment, first top side panel 550 includes opposing side edges 559 and 561 and a free edge 563 extending between side edges 559 and 561. Side edges 559, 561 and free edge 563 have various angled or curved segments as illustrated. Side edge 559 and free edge 563 define, at a first outer corner of first top side panel 550, a first corner locking projection 565. Side edge 561 and free edge 563 define, at a second outer corner of first top side panel 550, a second corner locking projection 567.

In the illustrated embodiment, first bottom side panel 552 has a depth $D_{12}$ that is more than about half of depth $D_{11}$ of container 800. Alternatively, first bottom side panel 552 has any suitable depth that enables blank 500 and/or container 800 to function as described herein. First bottom side panel 552 has a first angled side edge 580 and an opposing second angled side edge 582. A first shoulder edge 584 extends from first angled side edge 580 substantially parallel to fold line 556, and a second shoulder edge 586 extends from second angled side edge 582 substantially parallel to fold line 556. First shoulder edge 584 and first angled side edge 580 define a first shoulder projection 588, and, similarly, second shoulder edge 586 and second angled side edge 582 define a second shoulder projection 590. A first tab edge 592 extends from first shoulder edge 584, and an opposing second tab edge 594 extends from second shoulder edge 586. A free edge 596 extends between first and second tab edges 592, 594. Tab edges 592, 594 and free edge 596 define a locking tab 598. In the illustrated embodiment, locking tab 598 has beveled corners as shown. Locking tab 598 has a width $W_{12}$ and a depth $D_{13}$. A first shoulder joint 589 is defined by first shoulder projection 588 and locking tab 598, and a second shoulder joint 591 is defined by second shoulder projection 590 and locking tab 598.

Similarly, second side panel 520 includes a second top side panel 600 and a second bottom side panel 602 extending therefrom along respective fold lines 604 and 606. More specifically, second top side panel 600 extends from second side panel 520 along fold line 604, and second bottom side panel 602 extends from second side panel 520 along fold line 606.

In the illustrated embodiment, second top side panel 600 has a depth $D_{14}$ that is congruent with depth $D_{10}$ of first top side panel 550 and a width $W_{18}$ that is about equal to a width $W_{19}$ of second side panel 520. Alternatively, second top side panel 600 has any suitable depth and/or width that enables blank 500 and/or container 800 to function as described herein. In the illustrated embodiment, second top side panel 600 include opposing side edges 611 and 613 and a free edge 615 extending between side edges 611 and 613. Free edge 615 has various angled and/or curved segments as shown. Second top side panel 600 includes a fold line 609 that extends between side edges 611 and 613, parallel to fold line 604. Fold line 609 is positioned at a depth $D_{15}$ on second top side panel 600 that is less than half of the depth $D_{14}$. Free edge 615 and side edge 611 define, at a first outer corner of second top side panel 600, a third corner locking projection 617. Free edge 615 and side edge 613 define, at a second outer corner of second top side panel 600, a fourth corner locking projection 619.

In the illustrated embodiment, second bottom side panel 602 has a depth $D_{19}$ that is more than about half of depth $D_{11}$ of container 800, and may be congruent to D12. Alternatively, second bottom side panel 602 has any suitable depth that enables blank 500 and/or container 800 to function as described herein. Second bottom side panel 602 includes opposing side edges 630, 632 and a free edge 633 extending between side edges 630, 632. First side edge 630 extends from fold line 606, and second side edge 632 extends from fold line 606. Free edge 633 includes a first horizontal portion 634, a first vertical portion 636, a second horizontal portion 638, a second vertical portion 640, and a third horizontal portion 642. First vertical portion 636, second horizontal portion 638, and second vertical portion 640 define a locking indentation 644. In addition, first horizontal portion 634, first vertical portion 636, and first side edge 630 define a first locking extension 246. Second vertical portion 640, third horizontal portion 642, and second side edge 632 define a second locking extension 648. In the illustrated embodiment, locking indentation 644 has a width $W_{20}$ that is congruent to width $W_{12}$ of locking tab 598 and a depth $D_{16}$ that is congruent to a depth $D_{13}$ of locking tab 598.

First end panel 516 includes a first top end panel 660 and a first bottom end panel 662 extending therefrom along respective fold lines 664 and 666. More specifically, first top end panel 660 extends from first end panel 516 along fold line 664, and first bottom end panel 662 extends from first end panel 516 along fold line 666.

In the illustrated embodiment, first top end panel 660 has a width $W_{21}$ that is greater than a width $W_{13}$ of first end panel 516 and a depth $D_{17}$ that may be congruent with depth $D_{10}$. Alternatively, first top end panel 660 has any suitable depth and/or width that enables blank 500 and/or container 800 to function as described herein. First top end panel 660 includes opposing side edges 668, 670 and a free edge 672 extending between side edges 668, 670. A first angled edge 674 extends from first side edge 668, and a second angled edge 676 extends from second side edge 670. A first offset edge 678 extends from first angled edge 674 to fold line 664 and is configured to offset first angled edge 674 from fold line 664. A second offset edge 680 extends from second angled edge 676 to fold line 664 and is configured to offset second angled edge 676 from fold line 664. First top end panel 660 also includes a first locking aperture 669 and a second locking aperture 671. In the illustrated embodiment, first locking aperture 669 has a generally half-oval shape and is disposed at an oblique angle relative to first top end panel 660. Second locking aperture 671 is generally T-shaped. First locking aperture 669 is sized and positioned so as to receive second corner locking projection 567 when the top wall 828 of container 800 is constructed, as described herein. Second locking aperture 671 is sized and positioned so as to receive third corner locking projection 617 when the top wall 828 of container 800 is constructed.

First bottom end panel 662 includes a first side edge 682, an opposing second side edge 684, and a free edge 686 extending therebetween. In the illustrated second embodiment, as described further herein, first side edge 682 has a length $L_7$ that is less than or equal to about half of width $W_{16}$ of first side panel 512. A first angled edge 688 (also referred to herein as "first engagement member 688") extends from first side edge 682, and a first offset edge 690 extends between first angled edge 688 and fold line 666. First offset edge 690 is configured to offset first angled edge 688 from fold line 666. A shoulder edge 693 extends from second side edge 684 substantially parallel to fold line 666. A second angled edge 692 extends from first shoulder edge 693. A third angled edge 687 (also referred to herein as "second engagement member 687") extends from first angled edge 692. Second angled edge 692 and third angled edge 687 define a bottom corner projection 681. A second offset edge 689 extends between third angled edge 687 and fold line 666 and is configured to offset bottom corner projection 681 from fold line 666. First side edge 682, free edge 686, and second side edge 684 define a third locking extension 694. Shoulder edge 693 and second angled edge 692 define a shoulder projection 695. A shoulder joint 697 is defined by shoulder projection 695 and locking extension 694. In the illustrated embodiment, first angled edge 688 and third angled edge 687 are congruent and each has a length $L_8$. Length $L_8$ is congruent with a width $W_{22}$ of corner panels 510, 514, 518, and 522.

Similarly, second end panel 524 includes a second top end panel 700 and a second bottom end panel 702 extending therefrom along respective fold lines 704 and 706. More specifically, second top end panel 700 extends from second end panel 524 along fold line 704, and second bottom end panel 702 extends from second end panel 524 along fold line 706.

In the illustrated embodiment, second top end panel 700 is substantially a mirror-image of first top end panel 660. Second top end panel 700 has a width $W_{22}$ that is greater than width $W_{14}$ of second end panel 524 and a depth $D_{18}$. Moreover, depth $D_{18}$ is substantially equal to depth $D_{17}$ and width $W_{22}$ is substantially equal to width $W_{21}$. Alternatively, second top end panel 700 has any suitable depth and/or width that enables blank 500 and/or container 800 to function as described herein. Second top end panel 700 includes opposing side edges 708, 710 and a free edge 712 extending between side edges 708, 710. A first angled edge 714 extends from first side edge 708, and a second angled edge 716 extends from second side edge 710. A third offset edge 718 extends from first angled edge 714 to fold line 704 and is configured to offset first angled edge 714 from fold line 704.

A fourth offset edge 720 extends from second angled edge 716 to fold line 704 and is configured to offset second angled edge 716 from fold line 704. Second top end panel 700 also includes a third locking aperture 709 and a fourth locking aperture 711. In the illustrated embodiment, third locking aperture 709 mirrors second locking aperture 671. Thus, third locking aperture 709 is generally T-shaped. In the illustrated embodiment, fourth locking aperture 711 mirrors first locking aperture 669. Thus, fourth locking aperture 711 has a generally half-oval shape and is disposed at an oblique angle relative to second top end panel 700. Third locking aperture 709 is sized and positioned so as to receive fourth corner locking projection 619 when the top wall 828 of container 800 is constructed. Fourth locking aperture 711 is sized and positioned so as to receive first corner locking projection 565 when the top wall 828 of container 800 is constructed.

Second bottom end panel 702 is substantially a mirror-image of first bottom end panel 662 and includes a first side edge 722, an opposing second side edge 724, and a free edge 726 extending therebetween. In the illustrated embodiment first side edge 722 has a length $L_9$ that is less than or equal to about half of width $W_{16}$ of first side panel 512. Moreover, length $L_9$ is substantially equal to $L_7$. A first angled edge 728 (also referred to herein as "first engagement member 728") extends from first side edge 722, and a third offset edge 730 extends between first angled edge 728 and fold line 706. Third offset edge 730 is configured to offset first angled edge 728 from fold line 706. A shoulder edge 725 extends from second side edge 724 substantially parallel to fold line 706. A second angled edge 732 extends from first shoulder edge 725. A third angled edge 729 (also referred to herein as "second engagement member 729") extends from first angled edge 732. Second angled edge 732 and third angled edge 729 define a bottom corner projection 731. A fourth offset edge 733 extends between third angled edge 729 and fold line 706 and is configured to offset bottom corner projection 731 from fold line 706. First side edge 722, free edge 726, and second side edge define a fourth locking extension 734. Shoulder edge 725 and second angled edge 729 define a shoulder projection 727. A shoulder joiner 735 is defined by shoulder projection 727 and locking extension 734. In the illustrated embodiment, first angled edge 728 and third angled edge 729 are congruent with first and third angled edges 687, 688 of first bottom end panel 662, such that first and third angled edge 728, 729 each has length $L_8$.

In addition, in the illustrated embodiment, blank 500 includes a plurality of bottom machine cutouts 740, 742, 744. Each machine cutout 740, 742, 744 spaces a bottom panel 552, 662, 602, 702 from an adjacent bottom panel 552, 662, 602, 702. Blank 500 also includes a plurality of top machine cutouts 741, 743, 745. Each machine cutout 741, 743, 745 spaces a top panel 550, 660, 600, 700 from an adjacent top panel 550, 660, 600, 700. When any blank 100 is fabricated from a larger piece of sheet material, blank 500 must be cut to the size and shape necessary to form a container 800. Providing machine cutouts 740, 742, 744 that space apart adjacent bottom panels 552, 602, 662, 702, and machine cutouts 741, 743, 745 that space apart adjacent top panels 550, 660, 600, 700 facilitates improvement in processing speeds for fabricating blank 500 over fabricating blanks with more complex relationships between bottom and top panels by simplifying a die-cutting process thereof.

Figure 11:
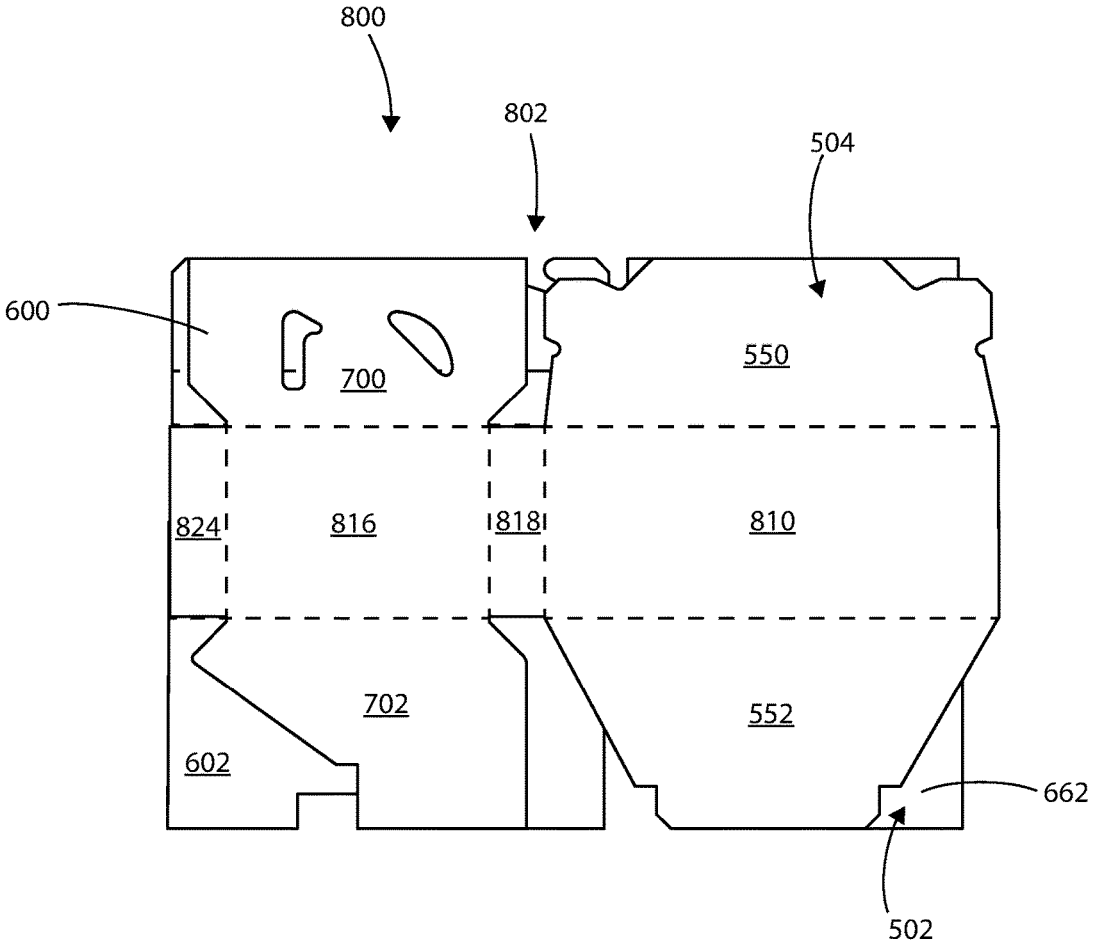
Figure 12:
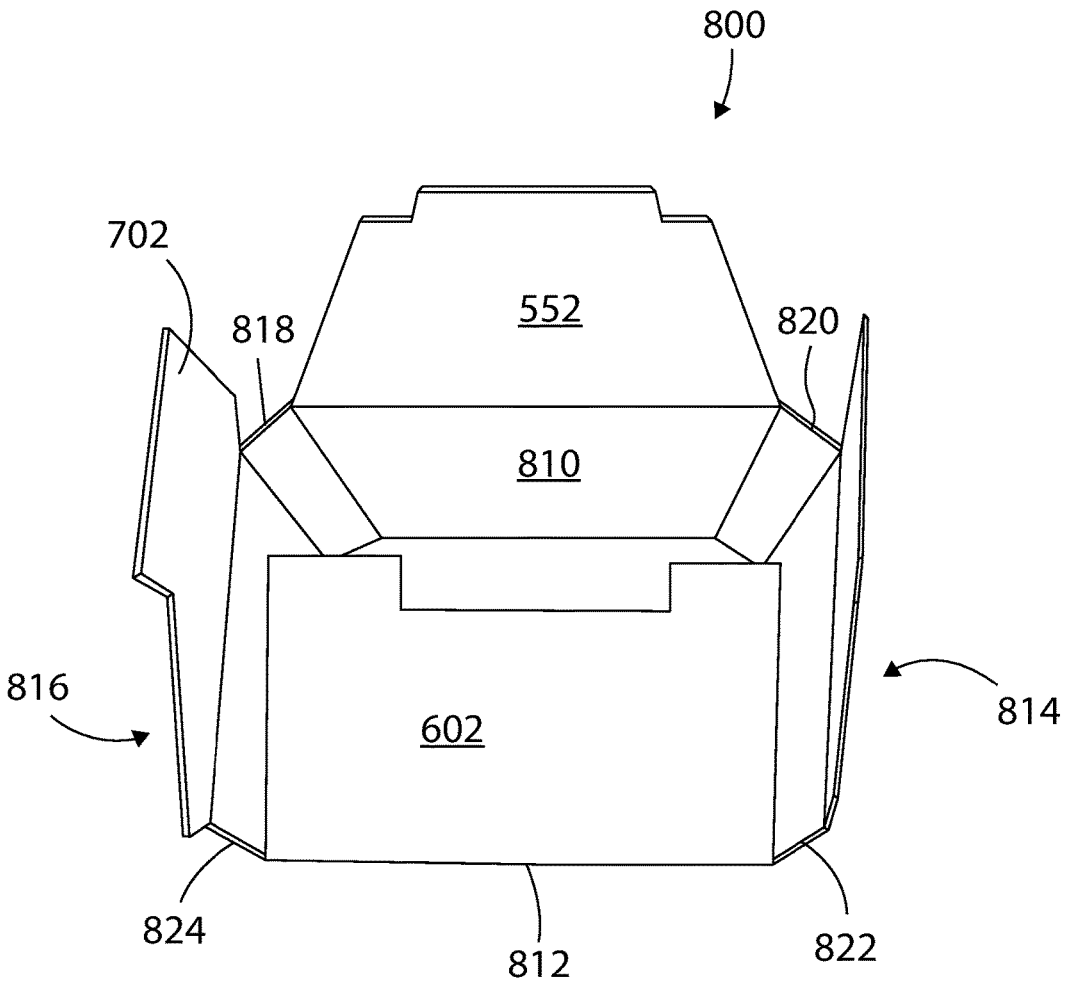
Figure 13:
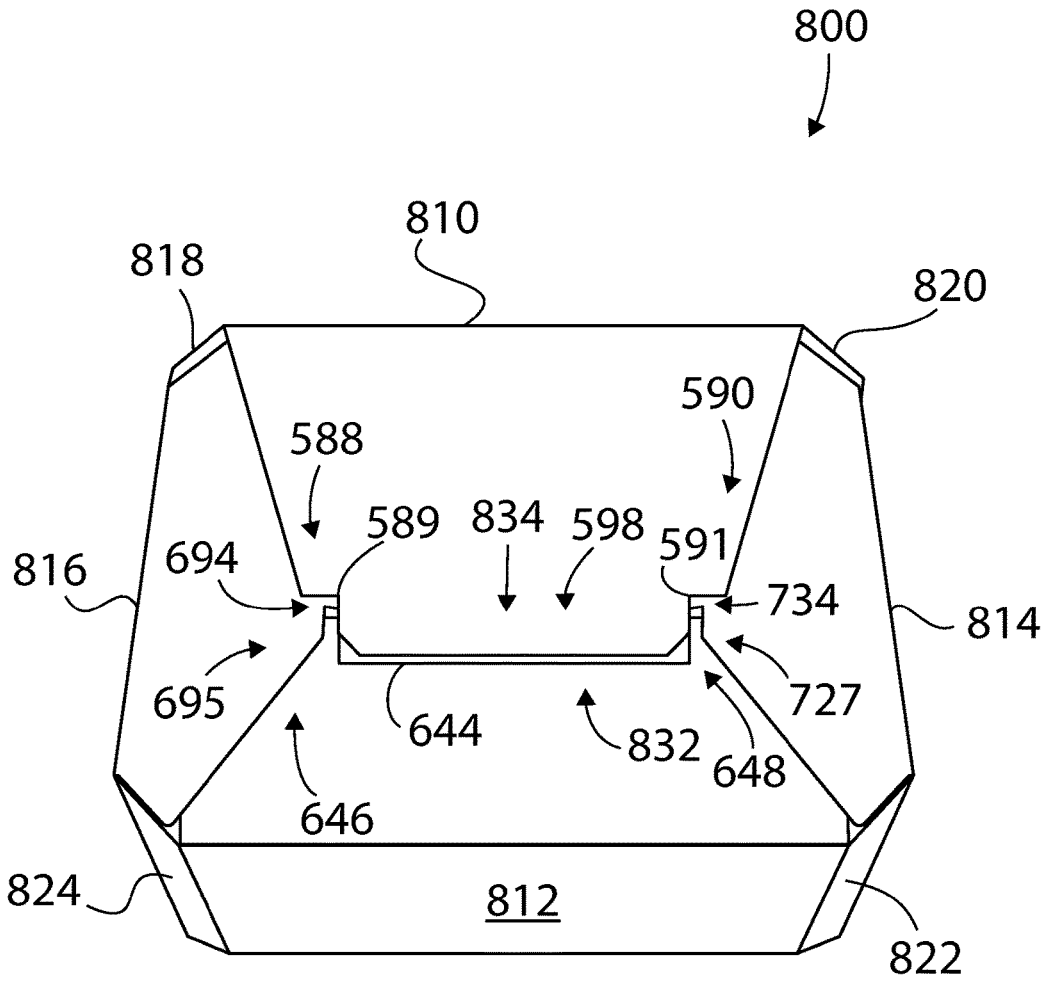
Figure 14:
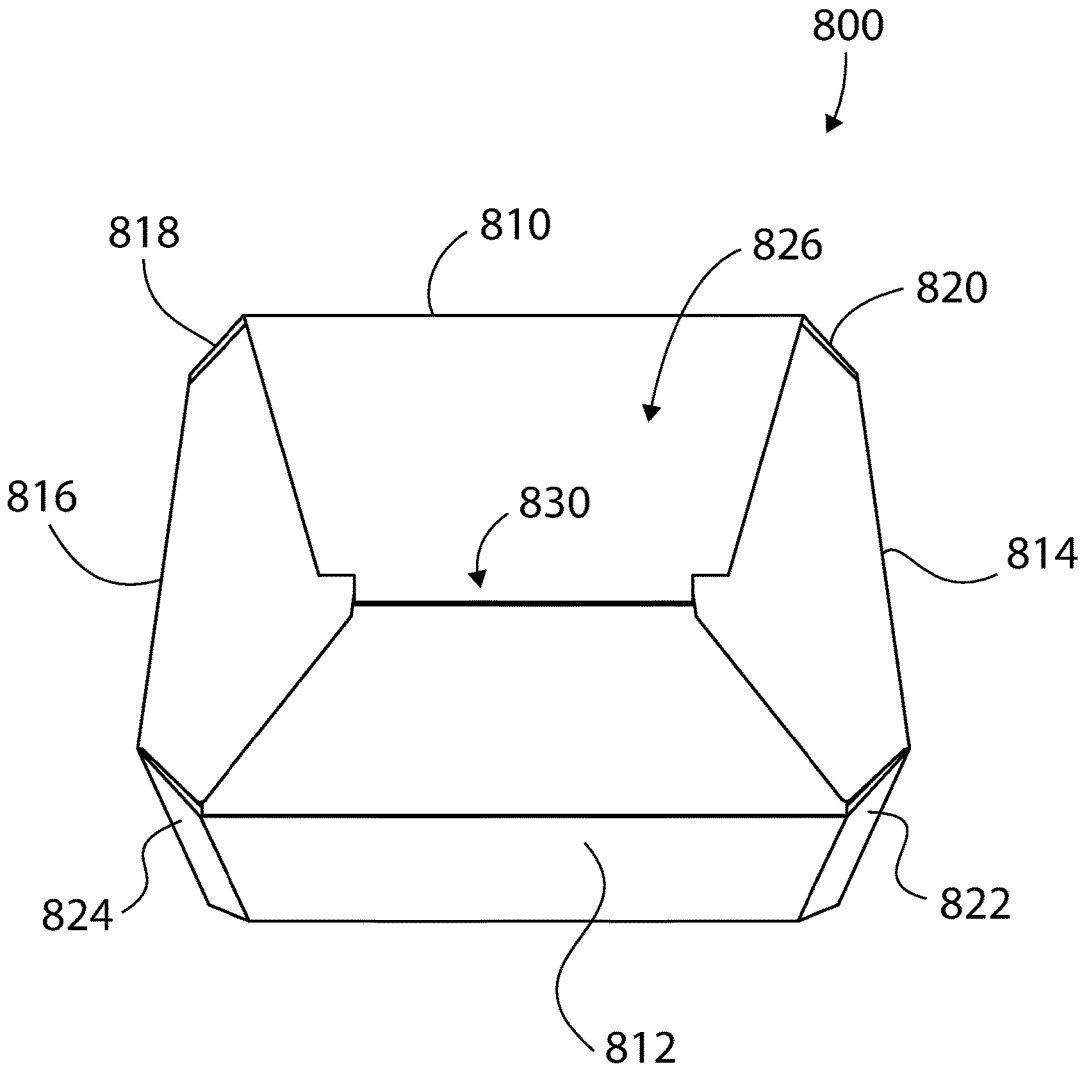
Figure 15:
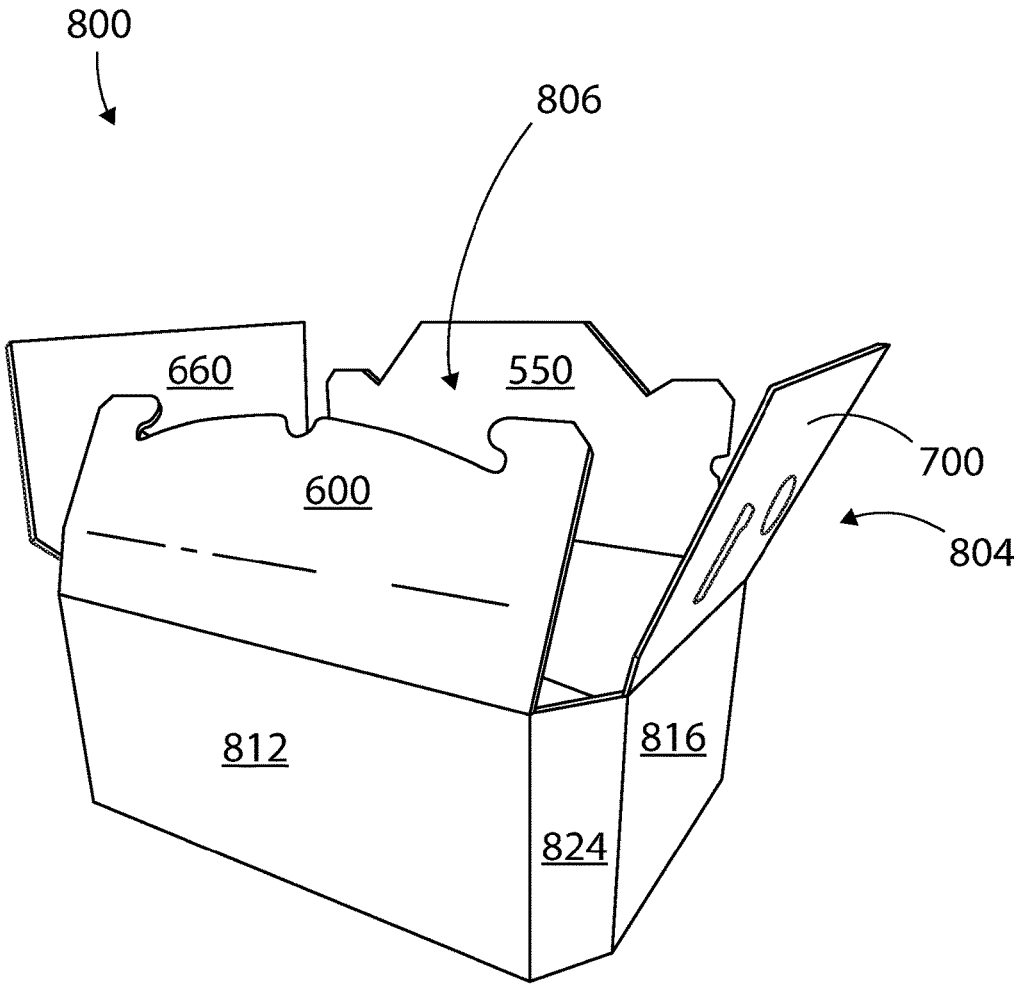
Figure 16:
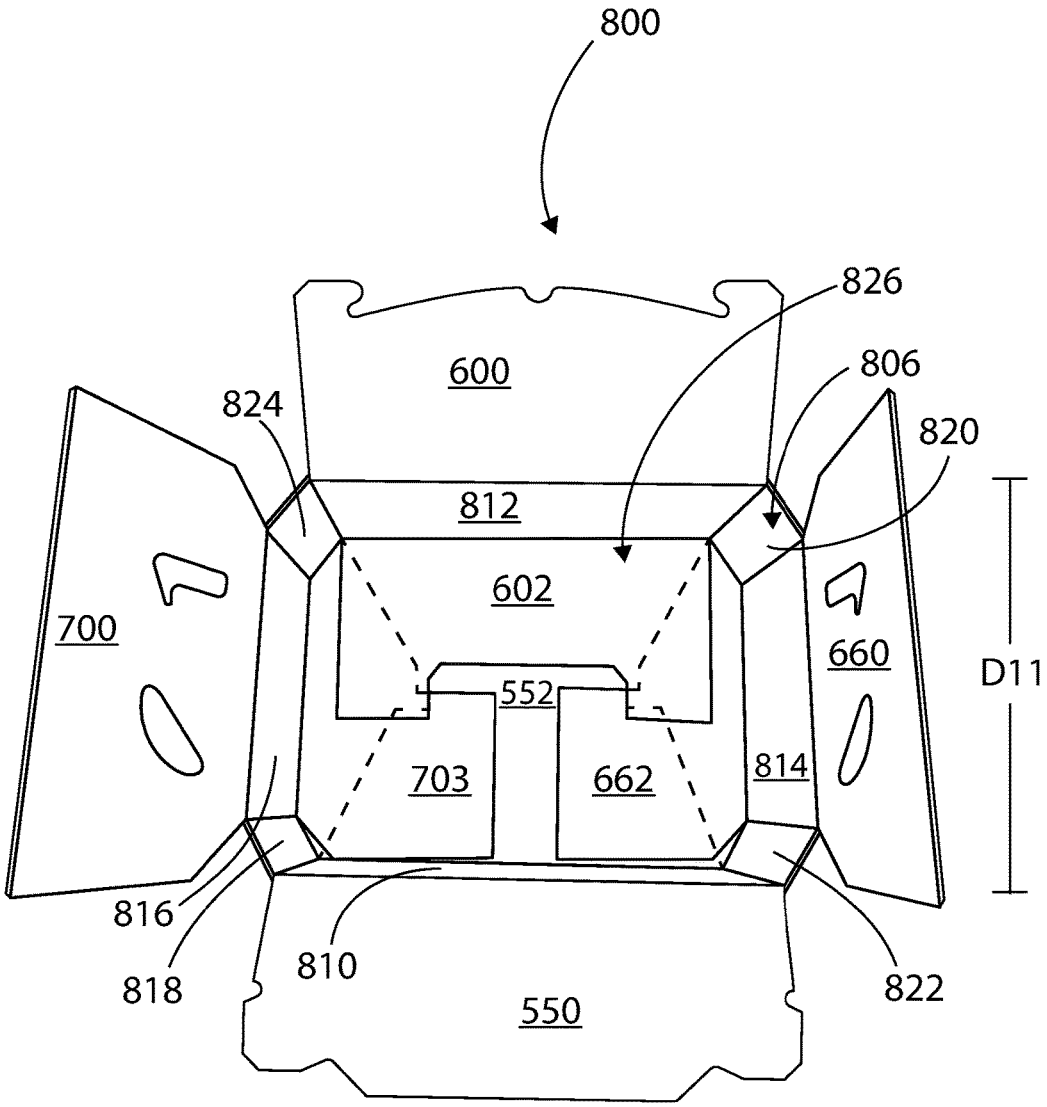
Figure 17:
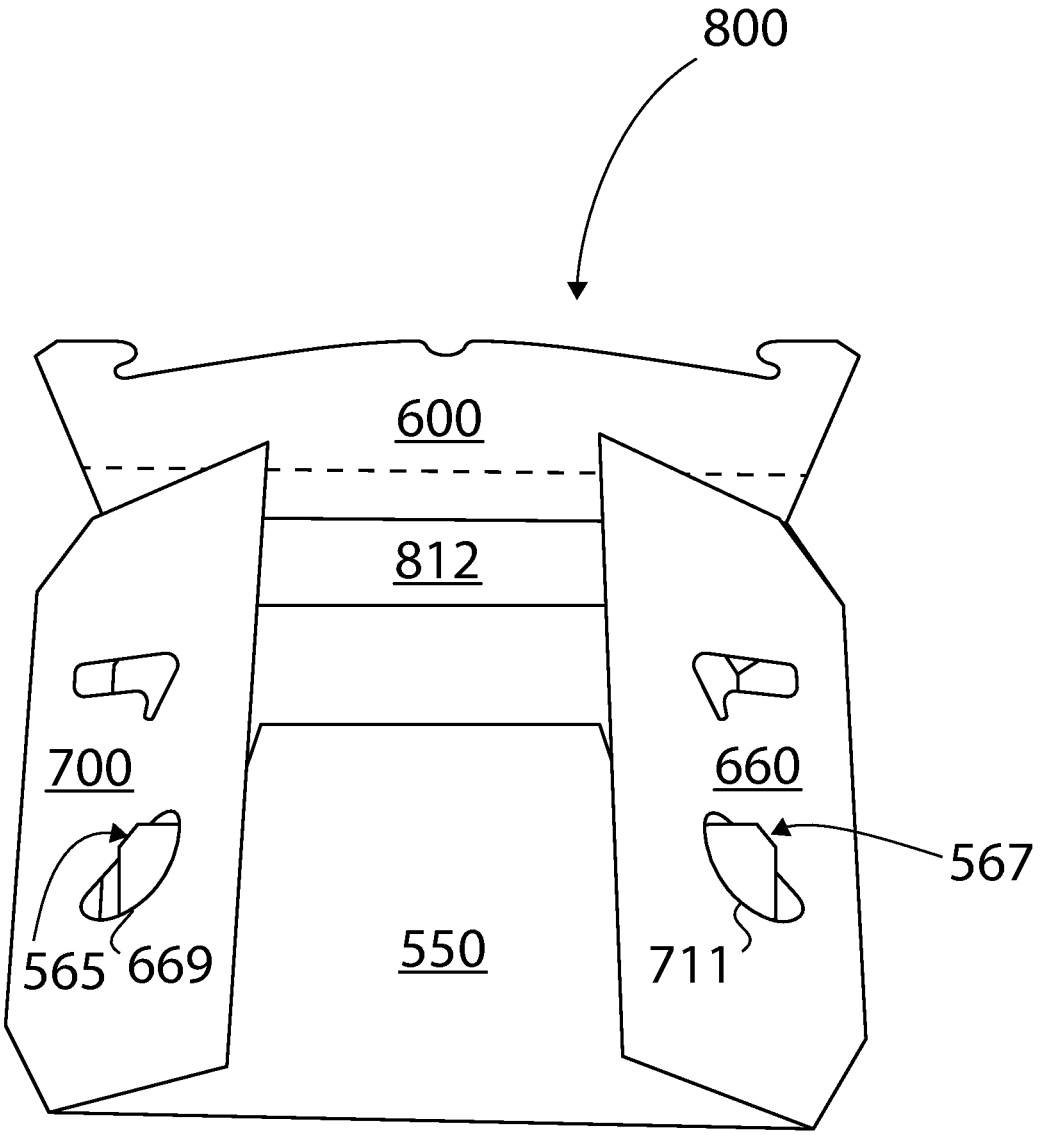
Figure 18:
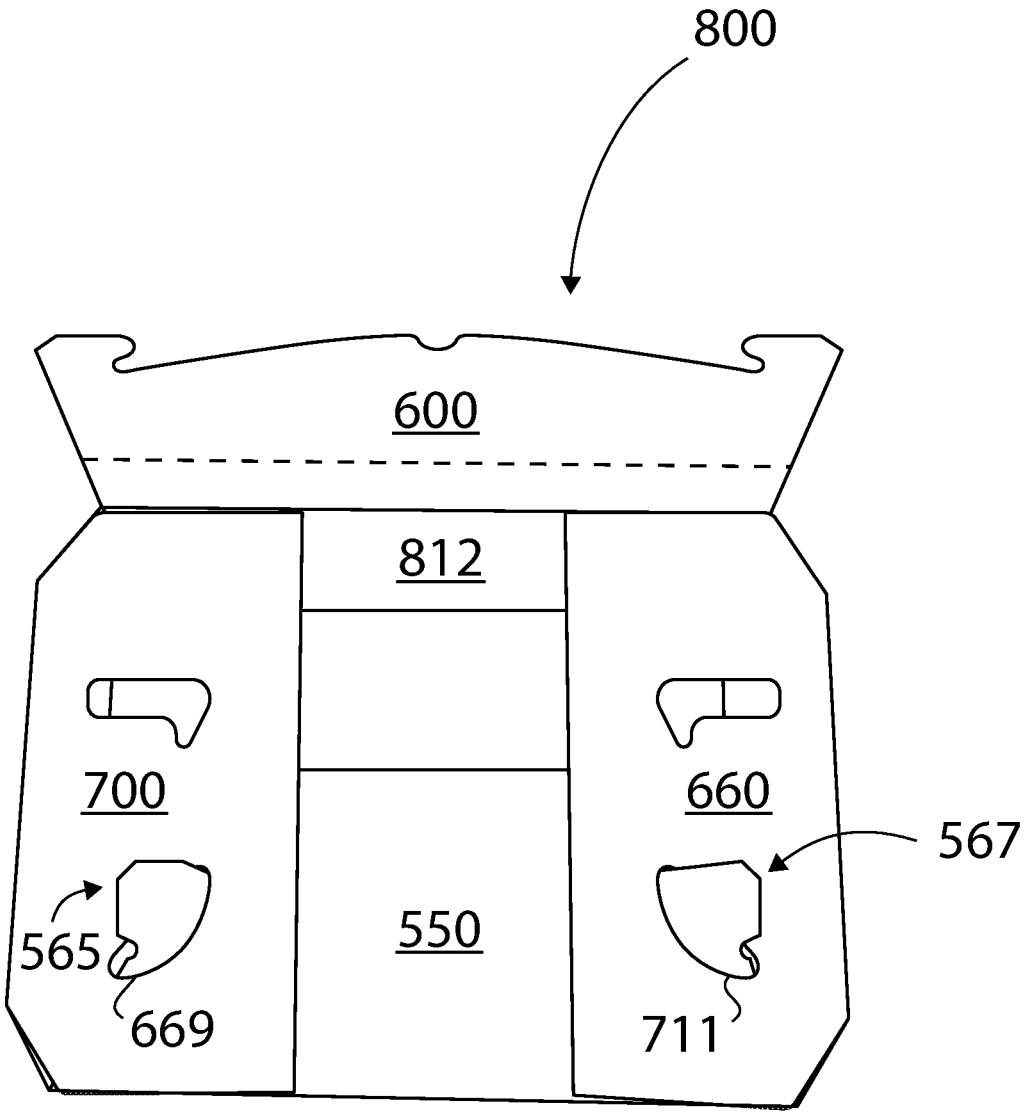
Figure 19:
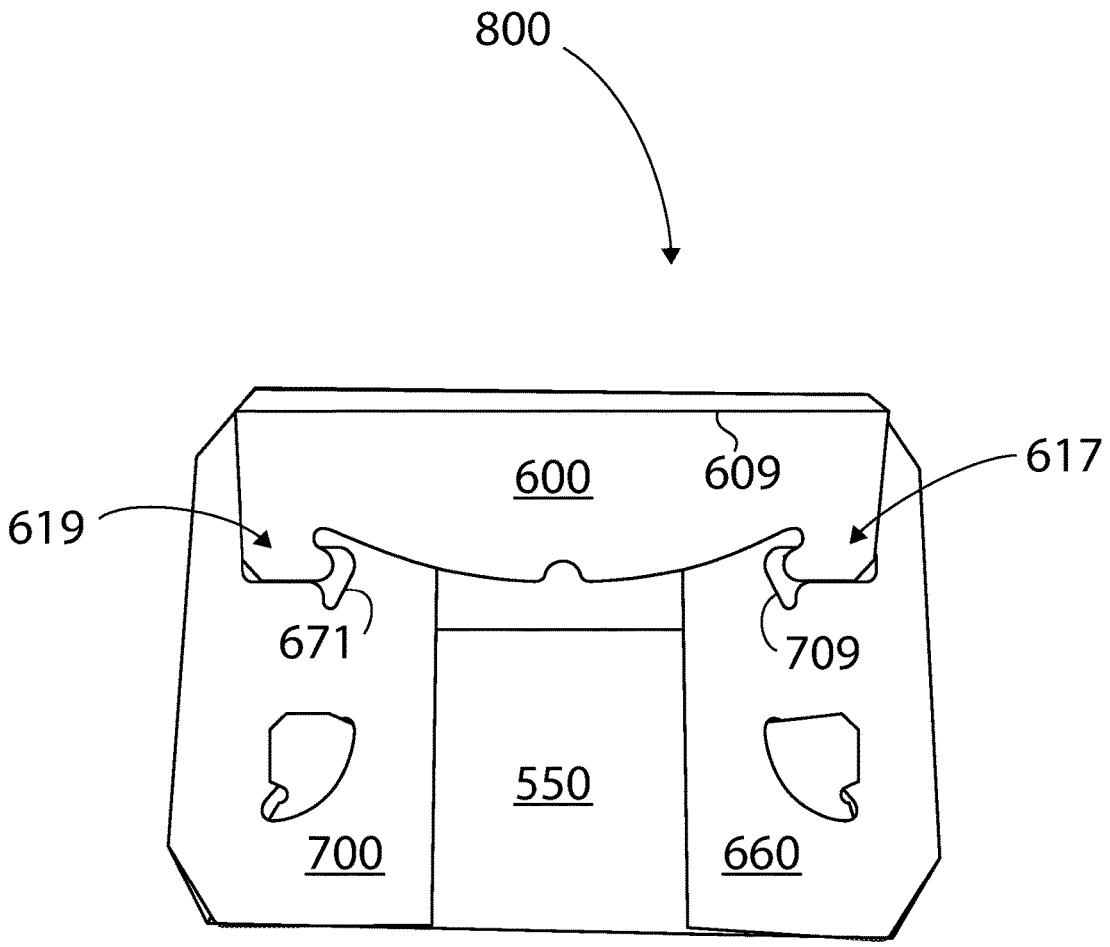
Figure 20:
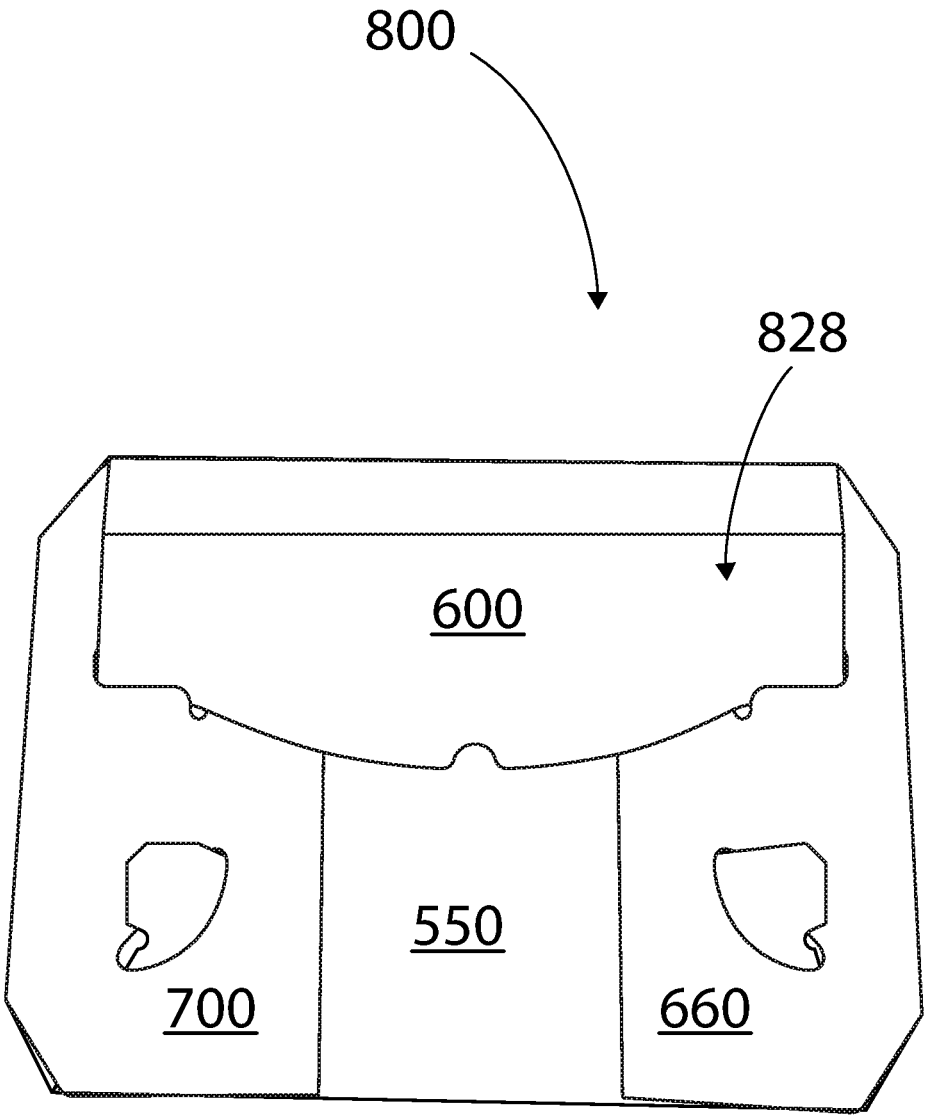

FIGS. 11-20 depict various views of container 800 in various stages of formation. More particularly, FIG. 11 is a top perspective view of a partially formed container 800 in a knocked-down-flat configuration 802. FIGS. 12-14 are bottom perspective views of the partially formed container 800 shown in FIG. 11 illustrating formation of a bottom wall 826 of container 800 to transition container 800 into an open configuration 804. FIG. 15 is a perspective view of container 800 shown in open configuration 804. FIG. 16 is a top perspective view of interior surface 502 of container 800 in open configuration 804. FIG. 17-19 are top perspective views showing steps in the formation of a top wall 828 of container 800. FIG. 20 is a top perspective view of a top wall 828 of container 800. Reference numerals in the "500s", "600s", and "700s" reference elements of blank 500, whereas reference numerals in the "800s" reference elements of container 800.

To construct container 800 from blank 800, first corner panel 510 is rotated about fold line 530 toward interior surface 502 of first side panel 512, first side panel 512 is rotated about fold line 532 toward interior surface 502 of second corner panel 514, second corner panel 514 is rotated about fold line 534 toward interior surface 502 of first end panel 516, first end panel 516 is rotated about fold line 536 toward interior surface 502 of third corner panel 518, third corner panel 518 is rotated about fold line 538 toward interior surface 502 of second side panel 520, second side panel 520 is rotated about fold line 540 toward interior surface 502 of fourth corner panel 522, fourth corner panel 522 is rotated about fold line 542 toward interior surface 502 of second end panel 524, and glue flap 526 is rotated about fold line 544 toward interior surface 502 of second end panel 524.

In the illustrated embodiment, after rotating panels 510, 512, 514, 516, 518, 520, 522, and 524, and glue flap 526 about fold lines 530, 532, 534, 536, 538, 540, 542, and 544, side panels 512 and 520 are substantially parallel to each other and substantially perpendicular to end panels 516 and 524; and first corner panel 510, glue flap 526, and third corner panel 518 are substantially parallel to each other and substantially perpendicular to second corner panel 514 and fourth corner panel 522. Panels 510, 512, 514, 516, 518, 520, 522, and 524, and glue flap 526 can be rotated about fold lines 530, 532, 534, 536, 538, 540, 542, and 544 by hand or by wrapping blank 500 about a mandrel within a machine.

Once panels 510, 512, 514, 516, 518, 520, 522, and 524, and glue flap 526 are rotated about fold lines 530, 532, 534, 536, 538, 540, 542, and 544, glue flap 526 is coupled to first corner panel 510. For example, in the illustrated embodiment, interior surface 502 of glue flap 526 is adhered to exterior surface 504 of first corner panel 510. Alternatively, exterior surface 504 of glue flap 526 is adhered to interior surface 502 of first corner panel 510. Further, although adhesive is described herein, glue flap 526 can be coupled to first corner panel 510 using any suitable fastener and/or technique. From this configuration, partially formed container 800 can be collapsed into a knocked-down-flat (KDF) configuration 802, as shown in FIG. 11.

In the illustrated embodiment, once glue flap 526 is coupled to first corner panel 510, first side panel 512 forms a first side wall 810 of container 800, and second side panel 520 forms a second side wall 812 of container 800. First end panel 516 forms a first end wall 814, and second end panel 524 forms a second end wall 816. First corner panel 510 and glue flap 526 form a first corner wall 818, second corner panel 514 forms a second corner wall 820, third corner panel 518 forms a third corner wall 822, and fourth corner panel 522 forms a fourth corner wall 824. Side walls 810 and 812, end walls 814 and 816, and/or corner walls 818, 820, 822, and 824 may be collectively or generally referred to as "side walls".

To transition container 800 from KDF configuration 802 to an open configuration 804 (shown in FIG. 15), a bottom wall 826 of container 800 is formed. More specifically, second bottom side panel 602 is rotated about fold line 606 toward interior surface 502 of second side panel 520 into a substantially perpendicular relationship with second side panel 520.

First bottom end panel 662 is rotated about fold line 666 toward interior surface 502 of first end panel 516 and into a face-to-face relationship with second bottom side panel 602. More specifically, interior surface 502 of first bottom end panel 662 is directly adjacent to and/or in direct contact with exterior surface 504 of second bottom side panel 602. This rotation positions first engagement member ("angled edge") 688 of first bottom end panel 662 in an abutting, edge-to-face relationship with interior surface 502 of second corner panel 514. In other words, first engagement member 688 of first bottom end panel 662 engages interior surface 502 of second corner wall 820 to reduce inward flexing of second corner wall 820 and help prevent movement of second corner wall 820 relative to side walls 810, 812, 814, 816, 818, 822, and/or 824. Such movement would cause container 800 to lose its properly aligned shape and reduce its stacking strength and/or stability. In addition, first side edge 682 (which is further referred to herein as "third engagement member 682") of first bottom end panel 662 is positioned in an abutting, edge-to-face relationship with interior surface 502 of first side panel 512. Third engagement member 682 of first bottom end panel 662 engages interior surface 502 of first side wall 810 to reduce inward flexing of first side wall 810 and help prevent movement of first side wall 810 relative to side walls 812, 814, 816, 818, 820, 822, and/or 824. In addition, third angled edge 687 (which is further referred to herein as "second engagement member 687") of first bottom end panel 662 is positioned in an abutting, edge-to-face relationship with interior surface 502 of third corner panel 518. Second engagement member 687 of first bottom end panel 662 engages interior surface 502 of third corner wall 822 to reduce inward flexing of third corner wall 822 and help prevent movement of third corner wall 822 relative to side walls 810, 812, 814, 816, 818, 820, and/or 824.

Second bottom end panel 702 is rotated about fold line 706 toward interior surface 502 of second end panel 524 and into a face-to-face relationship with second bottom side panel 602. More specifically, interior surface 502 of second bottom end panel 702 is directly adjacent to and/or in direct contact with exterior surface 504 of second bottom side panel 602. This rotation positions first engagement member ("first angled edge") 728 of second bottom end panel 702 in an abutting, edge-to-face relationship with interior surface 502 of first corner panel 510 (or glue flap 526). In other words, first engagement member 728 of second bottom end panel 702 engages interior surface 502 of first corner wall 818 to reduce inward flexing of first corner wall 818 and help prevent movement of first corner wall 818 relative to side walls 810, 812, 814, 816, 820, 822, and/or 824. In addition, first side edge 722 (which is further referred to herein as "third engagement member 722") of second bottom end panel 702 is positioned in an abutting, edge-to-face relationship with interior surface 502 of first side panel 512. Third engagement member 722 of second bottom end panel 702 engages interior surface 502 of first side wall 810 to reduce inward flexing of first side wall 810 and help prevent movement of first side wall 810 relative to side walls 812, 814, 816, 818, 820, 822, and/or 824. In addition, third angled edge 729 (which is further referred to herein as "second engagement member 729") of second bottom end panel 702 is positioned in an abutting, edge-to-face relationship with interior surface 502 of fourth corner panel 522. Second engagement member 729 of second bottom end panel 702 engages interior surface 502 of fourth corner wall 824 to reduce inward flexing of fourth corner wall 824 and help prevent movement of fourth corner wall 824 relative to side walls 810, 812, 814, 816, 818, 820, and/or 822.

In the illustrated embodiment of container 800, a bottom locking mechanism 830 includes locking tab 598, shoulder projections 588, 590, 695, and 727, shoulder joints 589, 591, 697, and 735, locking indentation 644, and locking extensions 646, 648, 694, and 734. Locking indentation 644 and locking extensions 646, 648, 694, and 734 define a locking slot 832, shown in FIG. 13. Alternatively, bottom locking mechanism 830 may include any suitable components and/or configuration that enables container 800 to be formed from blank 500.

First bottom side panel 552 is then rotated about fold line 556 toward interior surface 502 of first side panel 512. First bottom side panel 552 is rotated toward second bottom side panel 602 and bottom end panels 662 and 702 until panels 552, 602, 662, and 702 are rotated slightly upwardly into container 800. More specifically, panels 552, 602, 662, and 702 are rotated such that locking tab 598 can be inserted into locking slot 832 in the direction indicated by arrow 834. Locking tab 598 is inserted into locking slot 832 until shoulder joints 589, 591 abut second horizontal portion 638 of free edge 633 of second bottom side panel 602. In addition, shoulder joint 697 of first bottom end panel 662 abuts second tab edge 594 of first bottom side panel 552, and shoulder joint 735 of second bottom end panel 702 abuts first tab edge 592 of first bottom side panel 552. Shoulder joints 589, 591, 697, and 735 are configured to improve locking mechanism 430 in comparison to alternative locking mechanisms by enhancing the locking connection between locking tab 598 and locking indentation 644. Once locking tab 598 is inserted into locking slot 832, panels 552, 602, 662, and 702 rotate or settle outwardly to be substantially perpendicular to panels 510, 512, 514, 516, 518, 520, 522, and 524, and glue flap 526. When bottom panels 552, 602, 662, and 702 are in the substantially perpendicular configuration, bottom panels 552, 602, 662, and 702 are locked together to form bottom wall 826 of container 800. Locking mechanism 830 is configured to interlock bottom side panels 552 and 602 and bottom end panels 662 and 702 to form bottom wall 826 and maintain the integrity of bottom wall 826 under heavier loads (e.g., heavier products in container 800) and/or during handling of container 800 (e.g., during packing, shipping, storage) by reducing inward or outward flexing of bottom wall 826.

Moreover, as shown in FIG. 14, when bottom wall 826 is formed and locked via locking mechanism 830, corner walls 818, 820, 822, and 824 have improved stability from the respective engagement members 688, 687, 728, and 729 of bottom panels 662 and 702 engaged therewith. In particular, corresponding offset edges 690, 689, 733, 730 facilitate the edge-to-face relationships between engagement members 688, 687, 728, and 729 of bottom panels 662 and 702 and corner walls 820, 822, 824, and 818. Additionally, first side wall 810 has improved stability from the respective side edges 682 and 722 of respective first bottom end panel 662 and second bottom end panel 702 coupled thereagainst. In other words, by configuring bottom panels 552, 602, 662, and 602 as described herein, corner walls 818, 820, 822, and 824, side wall 810, and bottom wall 826 have improved stability over containers formed from blanks without engagement members 688, 687, 729, 728, 682, 722 of corresponding bottom panels.

When container 800 is transitioned to open configuration 804 (shown in FIGS. 15 and 16), side walls 810 and 812, end walls 814 and 816, corner walls 818, 820, 822, and 824, and bottom wall 826 define a cavity 806 of container 800. To close container 800 by forming top wall 828 as shown in FIG. 20, first top side panel 550 is rotated about fold line 554 toward interior surface 502 of first side panel 512. First top side panel 550 is rotated until it is at an angle with respect to first side panel 512 that allows first corner locking projection 565 and second corner locking projection 567 to be received through respective first locking aperture 669 of first top end panel 660 and fourth locking aperture 711 of second top end panel 700. This angle may be, for example, about 30 degrees. First top end panel 660 is then rotated about fold line 664 toward interior surface 502 of first end panel 516 until second corner locking projection 567 is received through first locking aperture 669; and second top end panel 700 is rotated about fold line 704 toward interior surface 502 of second end panel 526 until first corner locking projection 565 is received through fourth locking aperture 711. This results in the configuration shown in FIG. 17. First top end panel 660, second top end panel 700, and first top side panel 550 may then be rotated together about respective fold lines 664, 704, and 554 until first top end panel 660, second top end panel 700, and first top side panel 550 are substantially perpendicular to respective first end panel 516, second end panel 524, and first side panel 512 as shown in FIG. 18. These rotations position first angled edge ("first engagement member") 674 of first top end panel 660 in an abutting, edge-to-face relationship with second corner panel 514. In other words, first engagement member 674 of first top end panel 660 engages interior surface 502 of second corner wall 820 to further reduce inward flexing of second corner wall 820 and further prevent movement of second corner wall 820 relative to side walls 810, 812, 814, 816, 818, 822, and/or 824. Similarly, second angled edge ("second engagement member") 676 of first top end panel 660 is positioned in an abutting, edge-to-face relationship with interior surface 502 of third corner panel 518. Second engagement member 676 of first top end panel 660 engages interior surface 502 of third corner wall 822 to further reduce inward flexing of third corner wall 822 and further prevent movement of third corner wall 822 relative to side walls 810, 812, 814, 816, 818, 820, and/or 824. Similarly, first angled edge ("first engagement member") 714 of second top end panel 700 is positioned in an abutting, edge-to-face relationship with interior surface 502 of fourth corner panel 522. In other words, first engagement member 714 of second top end panel 700 engages interior surface 502 of fourth corner wall 824 to further reduce inward flexing of fourth corner wall 824 and further prevent movement of fourth corner wall 824 relative to side walls 810, 812, 814, 816, 818, 820, and/or 822. Similarly, second angled edge ("second engagement member") 716 of second top end panel 700 is positioned in an abutting, edge-to-face relationship with interior surface 502 of first corner panel 510 (or glue flap 526). Second engagement member 716 of second top end panel 700 engages interior surface 502 of first corner wall 818 to further reduce inward flexing of first corner wall 818 and further prevent movement of first corner wall 818 relative to side walls 810, 812, 814, 816, 820, 822, and/or 824.

As shown in FIG. 19, second top side panel 600 is then folded inwardly along fold line 609 toward interior surface of second side panel 520, as well as inwardly about fold line 604, until third corner locking projection 617 and fourth corner locking projection 619 are positioned with respect to respective second locking aperture 671 and 709 so as to allow third corner locking projection 617 and fourth corner locking projection 619 to be received through respective second locking aperture 671 and third locking aperture 709. Third corner locking projection 617 and fourth corner locking projection 619 are then inserted through respective second locking aperture 671 and third locking aperture 709. Second top side panel 600 is returned to a substantially planar configuration by folding the second top side panel 600 outwardly along fold line 609, while continuing to fold second top side panel 600 inwardly about fold line 604. After these rotations, second top side panel 600 is in a substantially planar configuration and is substantially perpendicular to second side panel 520. This completes the formation of top wall 828 as shown in FIG. 20.

In the illustrated second embodiment, top end panels 660 and 700 generally rest upon first top side panel 550 when top wall 828 is formed. As such, interior surface 502 of top end panels 660 and 700 is adjacent to and/or in direct contact with exterior surface 504 of first top side panel 550. In addition, however, portions of first top side panel 550 rest upon respective first and second top end panels 660, 700. More specifically, second corner locking projection 567 of first top side panel 550, which extends through first locking aperture 669, rests upon a portion of first top end panel 660; and first corner locking projection 565 of first top side panel 550, which extends through fourth locking aperture 711, rests upon a portion of second top end panel 700. In the illustrated embodiment, second top side panel 600 generally rests upon first top end panel 660 and second top end panel 700. As such, interior surface 502 of second top side panel 600 is adjacent to and/or in direct contact with exterior surface 504 of first top end panel 660 and second top end panel 700. In addition, however, portions of first top end panel 660 and second top end panel 700 rest upon second top side panel 600. More specifically, a portion of first top end panel 660 adjacent to second locking aperture 671 rests upon third corner locking projection 617 of second top side panel 600; and a portion of second top end panel 700 adjacent to third locking aperture 709 rests upon fourth corner locking projection 619 of second top side panel 600.

When top wall 828 is formed, corner walls 818, 820, 822, and 824 have improved stability from the respective engagement members 716, 674, 676, 714 of top end panels 660 and 700 engaged therewith. In particular, corresponding offset edges 720, 678, 680, 718 facilitate the edge-to-face relationships between engagement members 716, 674, 675, 714 of top end panels 660 and 700 and corner walls 818, 820, 822, and 824.

The embodiments described above provide a non-rectangular container that includes a bottom wall formed from interlocking bottom panels. The interlocking bottom panels enable the non-rectangular container to be finally formed without using adhesives. More specifically, the bottom panels securely interlock such that the bottom wall is formed without the need of glue, tape, and/or any other adhesive. As such, the containers described herein can be transported and/or stored in a knocked-down flat configuration, and erected automatically or manually without adhesive.

Further, the above-described embodiments provide a non-rectangular container that has better space efficiency, stacking strength, and/or bulge resistance as compared to rectangular containers. More specifically, the containers described herein include bottom panels having angled edges or engagement members configured to abut the interior surface of the corner walls or end walls of the erected container, which reduces wall flexing and relative movements of the side walls and improves the integrity of the erected containers. Each angled edge or engagement member is offset by an offset edge to facilitate such engagement with the container's interior. Moreover, the containers described herein include an improved bottom locking mechanism configured to reduce bottom sagging of the erected container.

Exemplary embodiments of blanks and methods for forming containers are described above in detail. The apparatus and methods are not limited to the specific embodiments described herein, but rather, components of apparatus and/or steps of the methods may be utilized independently and separately from other components and/or steps described herein. For example, the methods may also be used in combination with other containers and methods, and are not limited to practice with only the containers and methods as described herein. Rather, the exemplary embodiment can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank for forming a polygonal container, the blank comprising:

a plurality of side panels comprising a first side panel and a second side panel;

a corner panel connected to the first side panel and the second side panel by fold lines;

a bottom panel extending from the first side panel; and an engagement member defined on bottom panel, the engagement member configured to engage an interior surface of the corner panel to prevent movement of the corner panel relative to the first and second side panels when the container is formed from the blank;

wherein the bottom panel comprises a first bottom panel extending from a bottom edge of the first side panel, and wherein the plurality of side panels further comprises a third side panel and a fourth side panel, said blank further comprising:

a second bottom panel extending from a bottom edge of the second side panel;

a third bottom panel extending from a bottom edge of the third side panel; and a fourth bottom panel extending from a bottom edge of the fourth side panel, wherein the first bottom panel, the second bottom panel, the third bottom panel, and the fourth bottom panel are configured to define a locking slot and a locking tab that is insertable into the locking slot to form a portion of the bottom wall of the container;

wherein the first bottom panel defines a locking indentation, the locking indentation at least partially defining the locking slot, and the fourth bottom panel defines the locking tab and a pair of shoulder joints extending from the locking tab, the pair of shoulder joints configured to abut the locking indentation when the locking tab is inserted into the locking slot;

wherein each of the shoulder joints comprises a shoulder edge that extends between the locking tab and a respective angled side edge.

2. A blank in accordance with claim 1 wherein the engagement member has a length congruent to a width of the corner panel.

3. A blank in accordance with claim 1, wherein the engagement member comprises a first engagement member extending from a first side edge of the first bottom panel, said blank further comprising:

a second engagement member extending from a second, opposing side edge of the first bottom panel;

a third engagement member extending from a first side edge of the second bottom panel; and a fourth engagement member extending from a first side edge of the third bottom panel.

4. A blank in accordance with claim 1, wherein a first side edge of the bottom panel is configured to engage the interior surface of the first side panel and a second, opposing side edge of the bottom panel is configured to engage the interior surface of the second side panel when the container is formed from the blank.

5. A blank in accordance with claim 1 further comprising a top panel each extending from the second side panel, the top panel configured to form a portion of a top wall of the container.

6. A blank in accordance with claim 5, wherein the engagement member comprises a first engagement member, said blank further comprising a second engagement member defined on the top end panel, the second engagement member configured to engage the interior surface of the corner panel when the container is formed from the blank.

7. The blank of claim 1, wherein the engagement member extends from a first side edge of the bottom panel to an offset edge extending from a bottom edge of the first side panel.

8. A polygonal container comprising:

a plurality of side walls comprising a first side wall and a second side wall;

a corner wall extending between the first side wall and the second side wall;

a bottom wall comprising a bottom panel extending from a bottom edge of the first side wall; and an engagement member defined on the bottom panel, the engagement member engaging an interior surface of the corner wall to prevent movement of the corner wall relative to the first and second side walls;

wherein the plurality of side walls further comprises a third side wall and a fourth side wall, and wherein the bottom wall further comprises:

a second bottom panel extending from a bottom edge of the second side wall;

a third bottom panel extending from a bottom edge of the third side wall; and a fourth bottom panel extending from a bottom edge of the fourth side wall, wherein the first bottom panel, the second bottom panel, the third bottom panel, and the fourth bottom panel define a locking slot and a locking tab that is inserted into the locking slot to form a portion of the bottom wall;

wherein the first bottom panel defines a locking indentation, the locking indentation at least partially defining the locking slot, and the fourth bottom panel defines the locking tab and a pair of shoulder joints extending from the locking tab, the pair of shoulder joints abutting the locking indentation when the locking tab is inserted into the locking slot;

wherein each of the shoulder joints comprises a shoulder edge that extends between the locking tab and a respective angled side edge.

9. A container in accordance with claim 8, wherein the engagement member has a length congruent to a width of the corner wall.

10. A container in accordance with claim 9, wherein the engagement member comprises a first engagement member extending from a first side edge of the first bottom panel, said container further comprising:

a second engagement member extending from a second, opposing side edge of the first bottom panel;

a third engagement member extending from a first side edge of the second bottom panel; and a fourth engagement member extending from a first side edge of the third bottom panel.

11. A container in accordance with claim 8, wherein a first side edge of the bottom panel engages the interior surface of the first side wall and a second, opposing side edge of the bottom panel engages the interior surface of the second side wall.

12. A container in accordance with claim 8, further comprising a top wall comprising a top panel extending from a top edge of the second side wall.

13. A container in accordance with claim 12, wherein the engagement member comprises a first engagement member, said container further comprising a second engagement member defined on the top panel, wherein the second engagement member engages the interior surface of the corner wall.

14. The polygonal container of claim 8, wherein the engagement member extends from a first side edge of the bottom panel to an offset edge extending from a bottom edge of the first side panel.

* * * * *